US005207192A

United States Patent [19]

Smith

[11] Patent Number: 5,207,192

[45] Date of Patent: May 4, 1993

[54] VARIABLE CAMSHAFT TIMING SYSTEM UTILIZING SQUARE-EDGED SPOOL VALVE

[75] Inventor: Franklin R. Smith, Slaterville Springs, N.Y.

[73] Assignee: Borg-Warner Automotive Transmission & Engine Components Corporation, Sterling Heights, Mich.

[21] Appl. No.: 883,096

[22] Filed: May 15, 1992

[51] Int. Cl.[5] ..... F01L 1/34

[52] U.S. Cl. ..... 123/90.17; 123/90.31; 464/2

[58] Field of Search ..... 123/90.15, 90.17, 90.31; 464/2, 160

[56] References Cited

U.S. PATENT DOCUMENTS

| | | | |
|---|---|---|---|
| 5,002,023 | 3/1991 | Butterfield | 123/90.15 |
| 5,046,460 | 9/1991 | Butterfield et al. | 123/90.15 |
| 5,056,477 | 10/1991 | Linder et al. | 123/90.17 |
| 5,056,478 | 10/1991 | Ma | 123/90.17 |
| 5,078,647 | 1/1992 | Hampton | 123/90.17 |
| 5,088,456 | 2/1992 | Suga | 123/90.17 |
| 5,107,804 | 4/1992 | Becker et al. | 123/90.17 |
| 5,121,717 | 6/1992 | Simko et al. | 123/90.17 |

*Primary Examiner*—E. Rollins Cross
*Assistant Examiner*—Weilun Lo
*Attorney, Agent, or Firm*—Willian Brinks Olds et al.

[57] ABSTRACT

A camshaft (126) has a vane (160) secured to an end thereof for non-oscillating rotation therewith. The camshaft also carries a sprocket (132) which can rotate with the camshaft but which is oscillatable with respect to the camshaft. The vane has opposed lobes (**160*a*, 160*b*) which are received in opposed recesses (132*a*, 132*b*), respectively, of the sprocket. The recesses have greater circumferential extent than the lobes to permit the vane and sprocket to oscillate with respect to one another, and thereby permit the camshaft to change in phase relative to a crankshaft whose phase relative to the sprocket is fixed by virtue of a chain drive extending therebetween. The camshaft tends to change in reaction to pulses which it experiences during its normal operation, and it is permitted to change only in a given direction, either to advance or retard, by selectively blocking or permitting the flow of hydraulic fluid, preferably engine oil, through the return lines (194, 196) from the recesses by controlling the position of a spool (200) within a valve body (198) of a control valve in response to a signal indicative of an engine operating condition from an engine control unit (208). The spool contains square-edged lands (254, 256**) which prevent hydraulic fluid contamination from wedging between the valve body and the spool itself.

14 Claims, 19 Drawing Sheets

VARIABLE CAMSHAFT TIMING SYSTEM UTILIZING SQUARE-EDGED SPOOL VALVE

FIELD OF THE INVENTION

This invention relates to an hydraulic control system for controlling the operation of a variable camshaft timing (VCT) system of the type in which the position of the camshaft is circumferentially varied relative to the position of a crankshaft in reaction to torque reversals experienced by the camshaft during its normal operation. In such a VCT system, an hydraulic system is provided to effect the repositioning of the camshaft in reaction to such torque reversals, and a control system is provided to selectively permit or prevent the hydraulic system from effecting such repositioning.

BACKGROUND OF THE INVENTION

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position of a camshaft relative to a crankshaft. U.S. Pat. No. 5,107,804 further describes a VCT system within the field of the invention in which the system hydraulics includes a vane having lobes within an enclosed housing, the vane being oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft.

The control system for the VCT system of U.S. Pat. No. 5,002,023 utilizes a spool type control valve in which the exhaustion of hydraulic fluid from one or another of the oppositely acting cylinders is permitted by moving a spool within the valve one way or another from its centered or null position. A VCT control valve, such as that of the aforesaid U.S. Pat. No. 5,002,023, has three functions: control the direction the VCT actuates; control the rate at which the VCT actuates; and stop the VCT at a specified phase position.

Stopping the VCT phase shifting elements in a specified position is accomplished by blocking the flow of hydraulic fluid into or out of the hydraulic chambers. The VCT phase shift direction is determined by selectively opening the appropriate exhaust passage allowing hydraulic fluid to exhaust one chamber and fill the other.

The VCT actuation rate is determined by governing the rate of flow from the selected exhaust passage. This is accomplished by the control valve, typically a spool valve, varying the flow area exposed at the exhaust port selected. The area exposed at the exhaust port is a function of two variables: the percentage of the hole in the sleeve that is exposed as the spool valve moves axially, and the radial gap between the spool valve and the sleeve. In a typical spool valve, the radial gap is increased with the spool valve stroke by a taper which is machined on the outside diameter of the valve. These spool and sleeve characteristics result in the flow area varying hyperbolically as a function of the spool valve stroke.

While the tapered spool valve design produces desirable flow characteristics, it also presents operational problems. One problem is that the tapered portion of the valve can potentially collect contamination. If the contamination wedges between the spool valve and sleeve, the valve may seize causing the VCT to lose control.

SUMMARY OF THE INVENTION

The present invention provides an improved method and apparatus for controlling the flow characteristics in a hydraulic control valve. Specifically, the present invention provides an improved method and apparatus for controlling the flow characteristics in a hydraulic control valve in a VCT system, for example, an hydraulic control valve which is used in an oppositely-acting hydraulic cylinder VCT timing system of the type disclosed in U.S. Pat. No. 5,002,023, or an hydraulic control valve which is used in a vane-type VCT timing system of the type disclosed in U.S. Ser. No. 713,465.

The VCT is continuously variable under closed loop control. This requires a control valve with a flow area versus spool valve position curve which is approximately hyperbolic. The requirement is that the flow area increase at a slow rate just either side of the null position to accomplish a slow actuation rate which is good for fine control and small phase positional changes. The flow area needs to increase at a large rate the further the spool travels from the null position to accomplish fast actuation rates over larger phase position changes. A spool valve tapered on the outside diameter of the valve produces the desired flow characteristics, but the taper can trap contamination which may become wedged between the spool valve and sleeve causing the control valve to seize and lose control.

The desired flow area versus spool position curve can be created, however, utilizing a square edged valve and sleeve combination with two or more exhaust orifices per hydraulic cylinder with lesser risk of contamination and valve seizure. By varying the orifice diameter and/or the amount these orifices overlap axially, the desired flow area versus spool position curve can be developed.

In one embodiment of the present invention, the orifice diameters are different. The inboard orifices are small diameter and as the square edged valve strokes, it opens up the small orifice first exposing a known flow area for a given valve stroke. These are called primary orifices and offer slow actuation rates and fine control around the null position. Further, outboard are the larger diameter secondary orifices. These expose greater flow area for a given valve stroke and allow faster actuation rates.

In another embodiment of the present invention, the primary and secondary orifices are of equal diameter. The primary orifice is still located inboard and changes flow area in small increments to obtain fine control. However, the secondary orifice overlaps the primary orifice such that before the primary orifice is fully open the secondary orifice starts to open as well. In this region of spool valve travel, the flow area is increasing at a large rate because two orifices being opened simultaneously. This increased area provides higher flow rates that translate to higher actuation rates as the spool valve strokes further from the null position. A good valve practice would be to locate the primary and secondary orifices 180 degrees from one another to balance the pressure on the outer diameter of the valve.

Accordingly, it is an object of the present invention to provide an improved method and apparatus for controlling the flow characteristics of a hydraulic control valve of the spool type. It is a further object of the present invention to provide an improved method and apparatus for controlling the flow characteristics of a hydraulic control valve of the spool type in an automotive variable camshaft timing system which utilizes oppositely acting, torque reversal reactive hydraulic means.

For a further understanding of the present invention and the objects thereof, attention is directed to the drawings and the following brief descriptions thereof, to the detailed description of the preferred embodiment, and to the appended claims.

DETAILED DESCRIPTION OF THE PREFERRED EMBODIMENT

Figure 1:
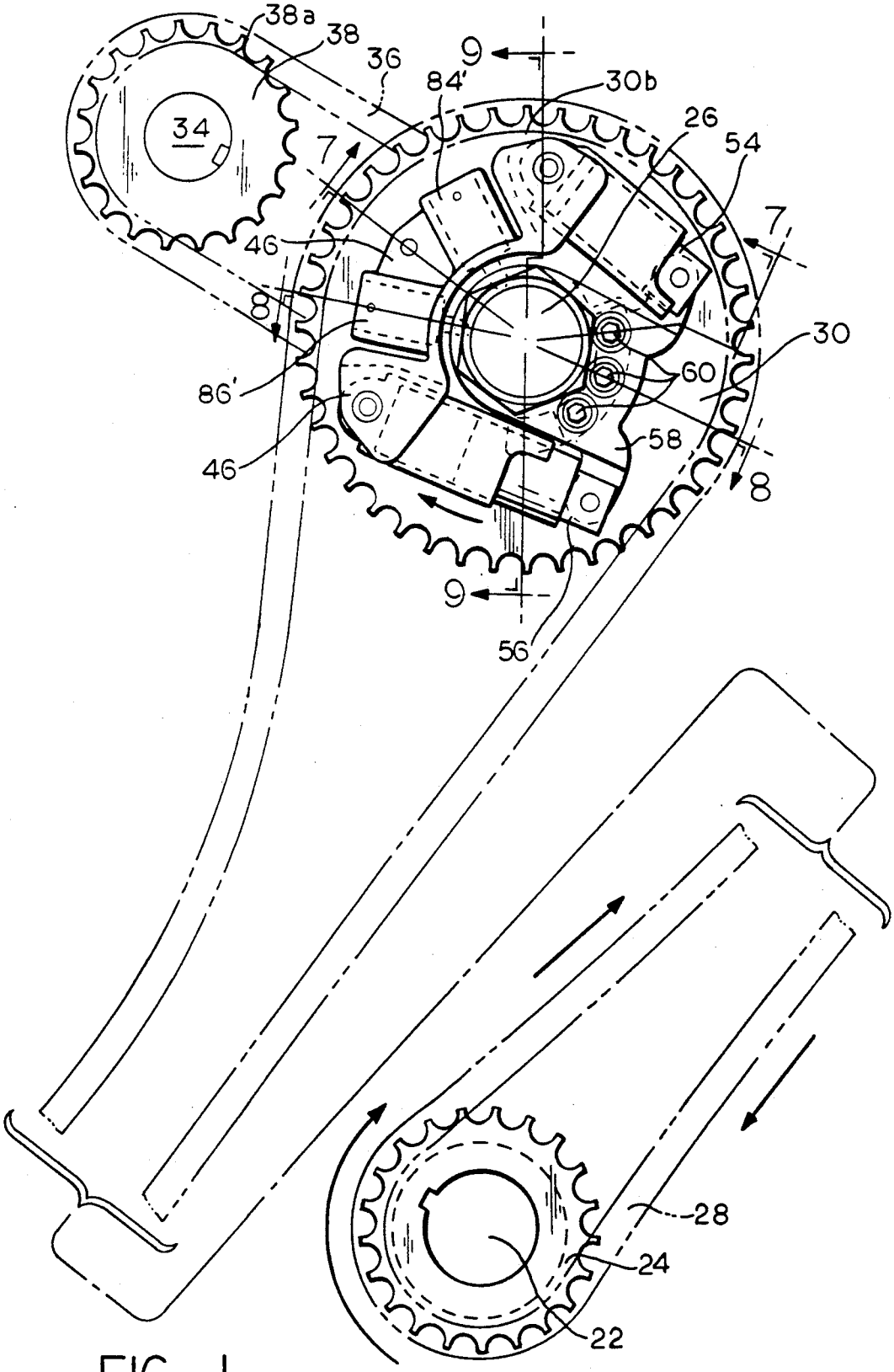
FIG. 1 is a fragmentary view of a dual camshaft internal combustion engine incorporating an embodiment of a variable camshaft timing arrangement according to the present invention, the view being taken on a plane extending transversely through the crankshaft and the camshafts and showing the intake camshaft in a retarded position relative to the crankshaft and the exhaust camshaft.

In the embodiment of FIGS. 1–9, a crankshaft 22 has a sprocket 24 keyed thereto, and rotation of the crankshaft 22 during the operation of the engine in which it is incorporated, otherwise not shown, is transmitted to an exhaust camshaft 26, that is, a camshaft which is used to operate the exhaust valves of the engine, by a chain 28 which is trained around the sprocket 24 and a sprocket 30 which is keyed to the camshaft 26. Although not shown, it is to be understood that suitable chain tighteners will be provided to ensure that the chain 28 is kept tight and relatively free of slack. As shown, the sprocket 30 is twice as large as the sprocket 24. This relationship results in a rotation of the camshaft 26 at a rate of one-half that of the crankshaft 22, which is proper for a 4-cycle engine. It is to be understood that the use of a belt in place of the chain 28 is also contemplated.

Figure 6:
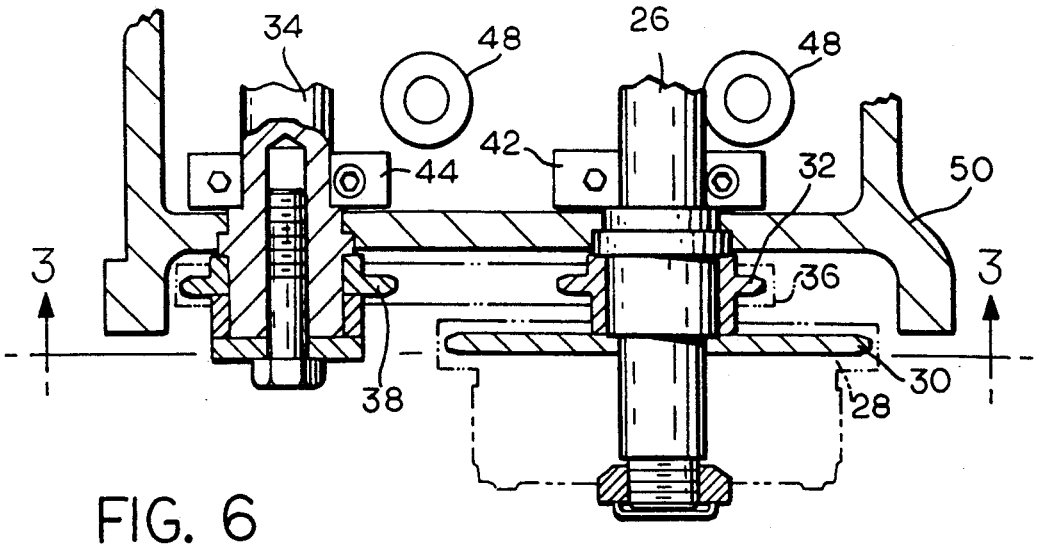
FIG. 6 is a fragmentary view taken on line 6—6 of FIG. 4.
Figure 3:
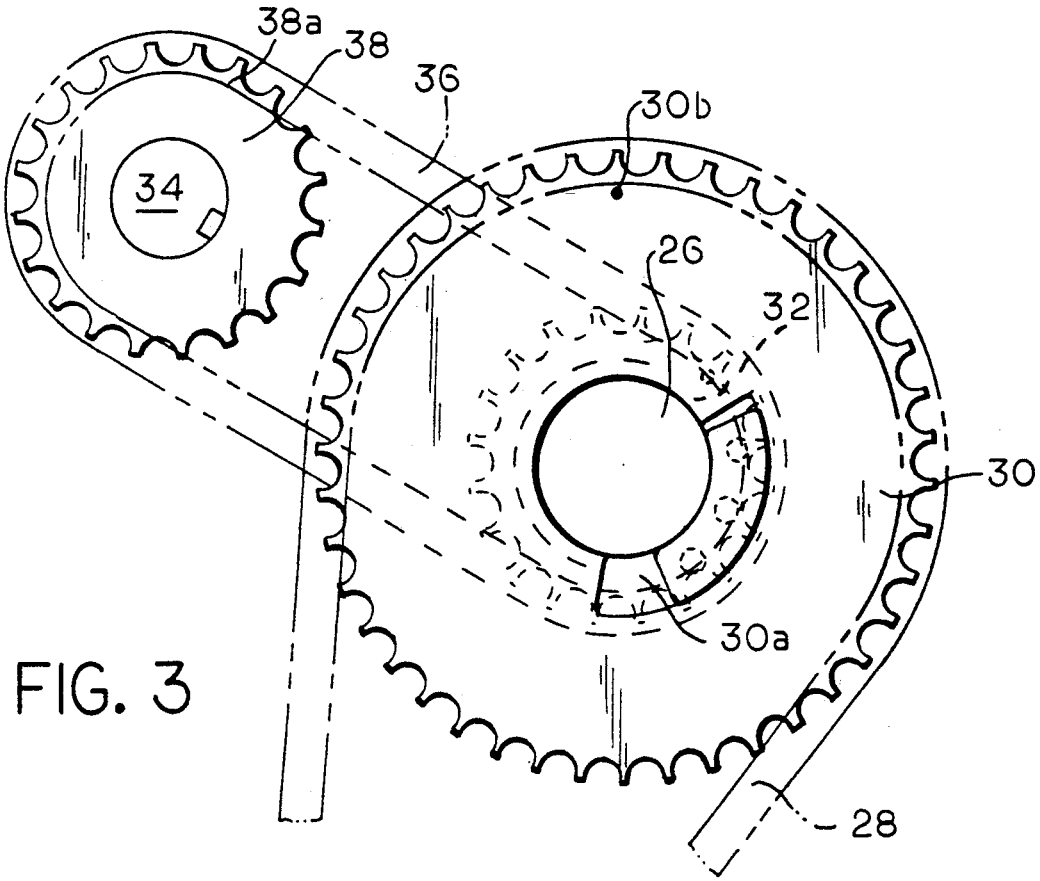
FIG. 3 is a fragmentary view taken on line 3—3 of FIG. 6 with some of the structure being removed for the sake of clarity and being shown in the retarded position of the device.
Figure 5:
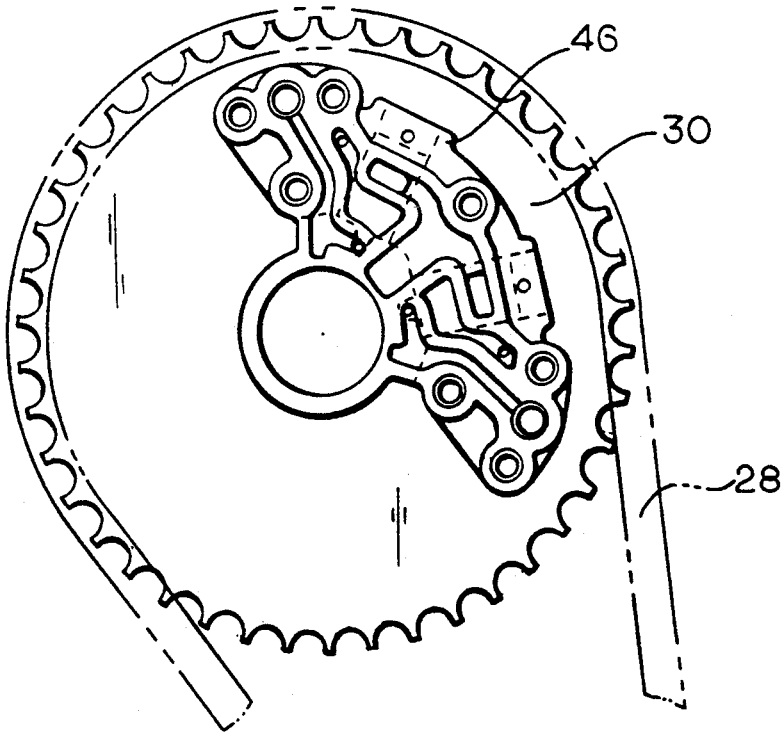
FIG. 5 is a fragmentary view showing the reverse side of some of the structure illustrated in FIG. 1.
Figure 4:
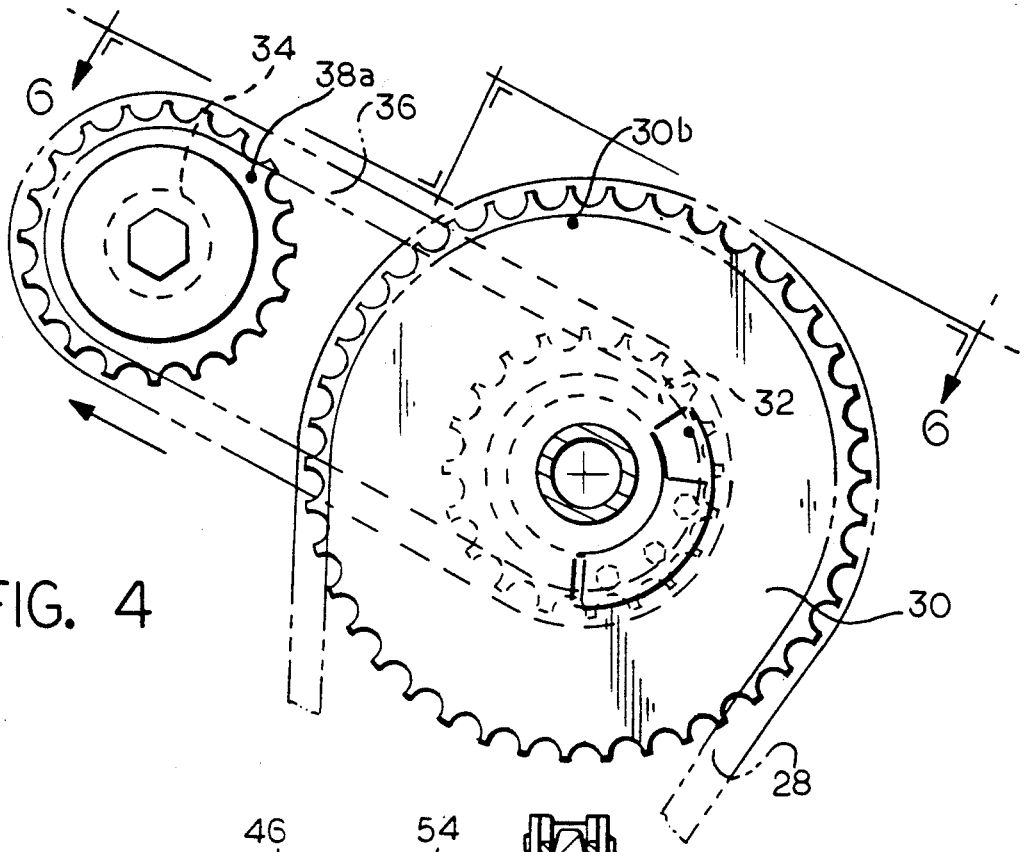
FIG. 4 is a fragmentary view similar to FIG. 3 showing the intake camshaft in an advanced position relative to the exhaust camshaft.
Figure 9:
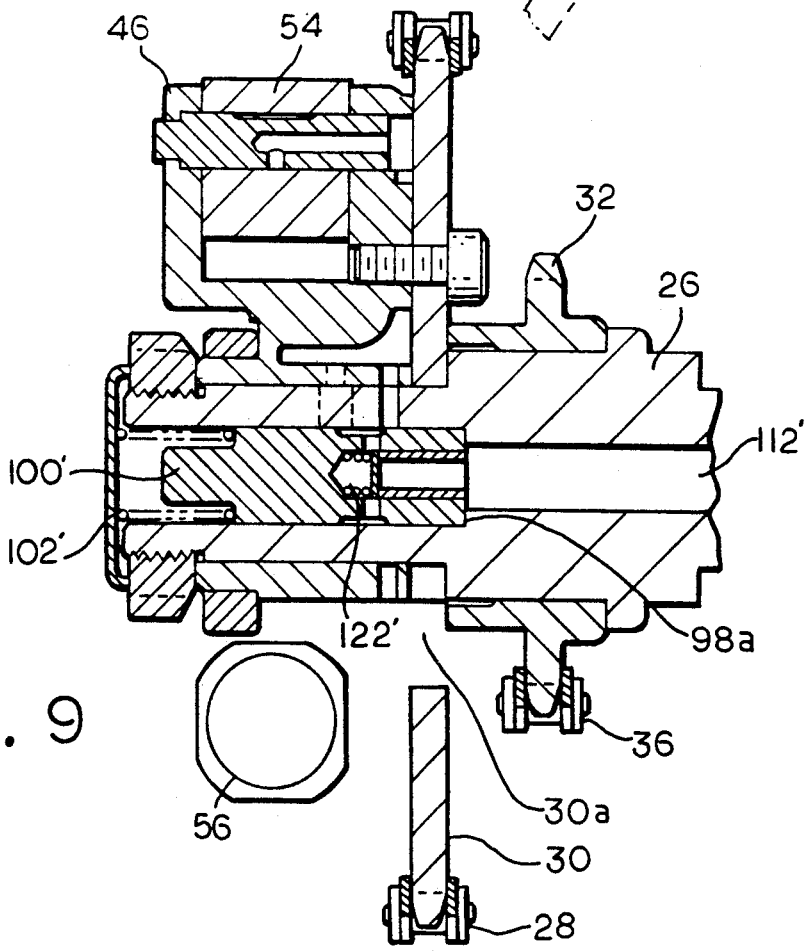
FIG. 9 is a sectional view taken on line 9—9 of FIG. 3.
Figure 7:
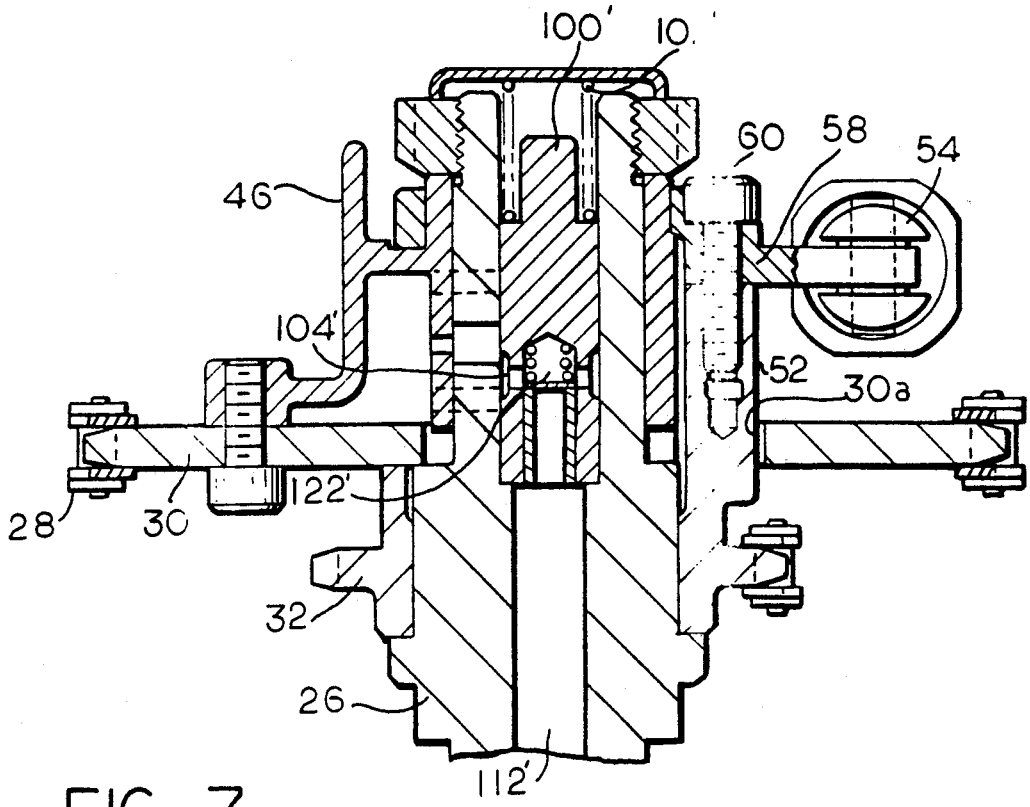
FIG. 7 is a fragmentary view taken on line 7—7 of FIG. 1.
Figure 8:
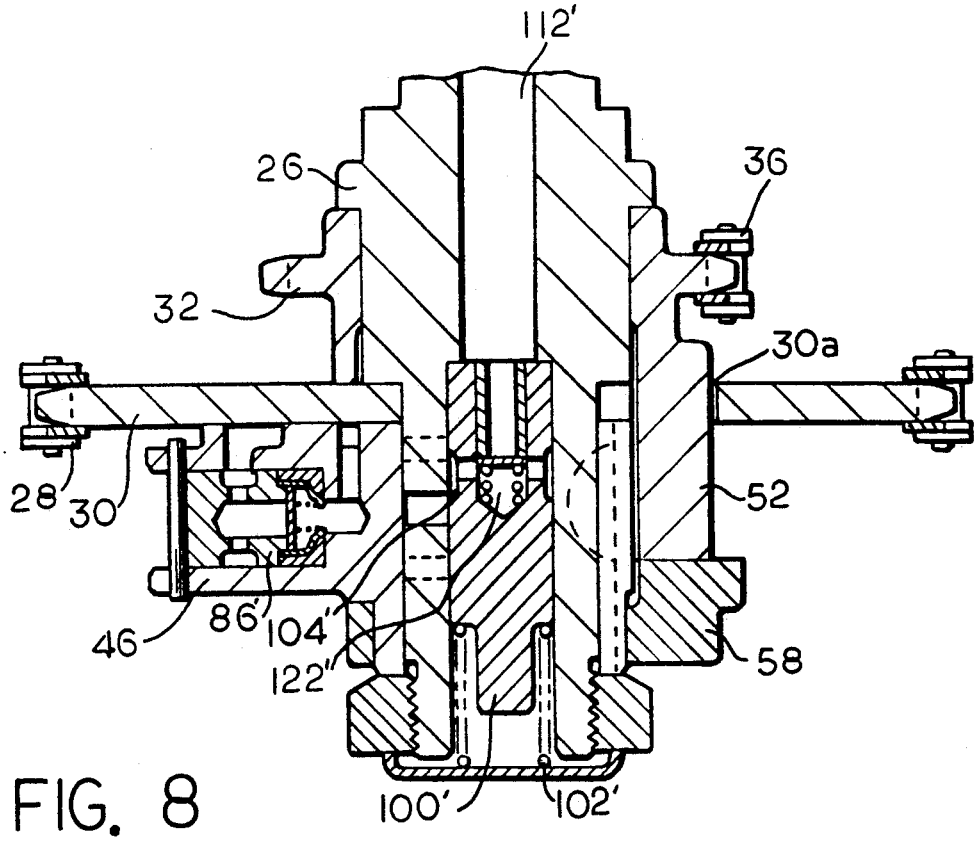
FIG. 8 is a sectional view taken on line 8—8 of FIG. 1.
Figure 10:
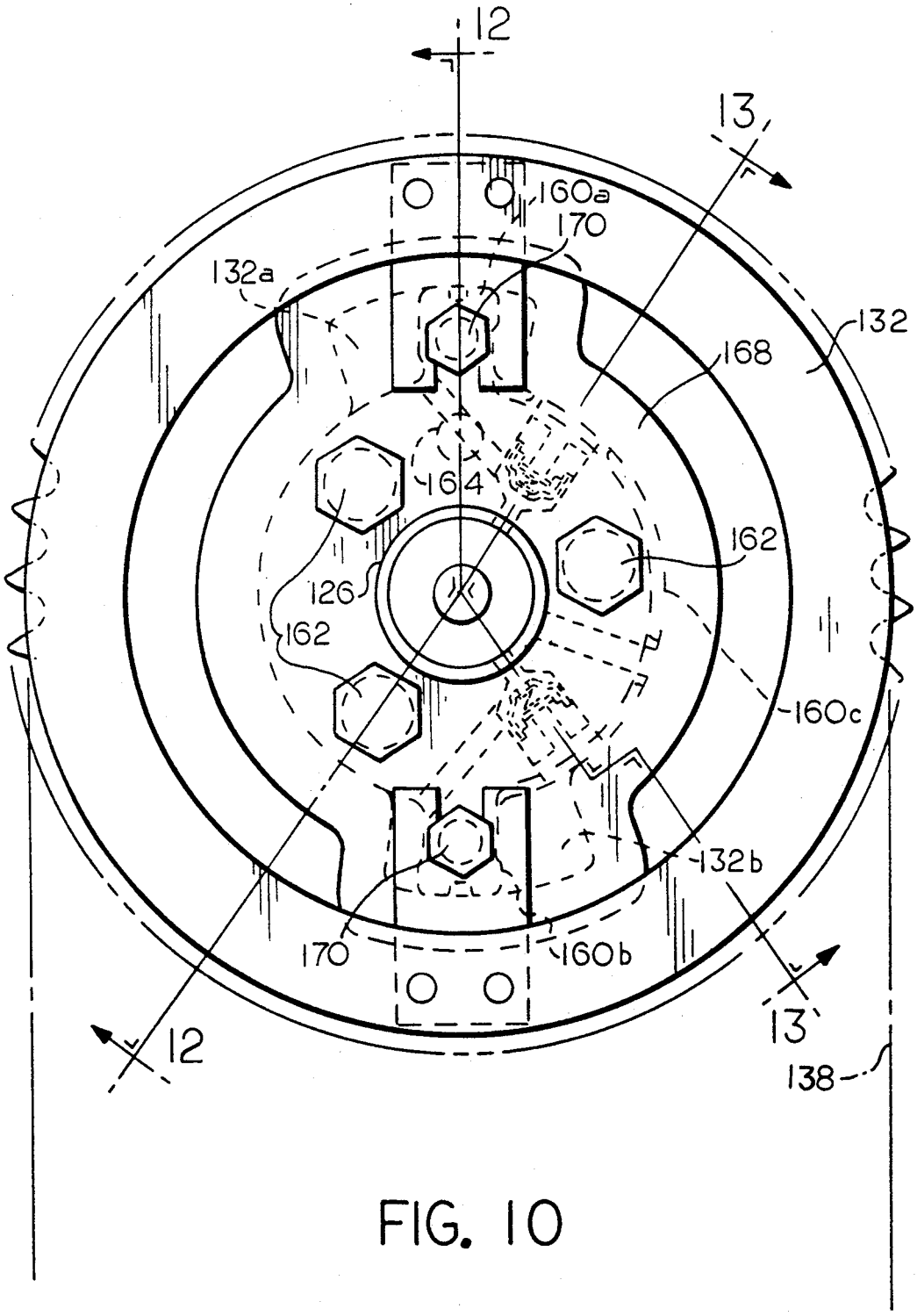
FIG. 10 is an end elevational view of a camshaft with an alternative embodiment of a variable camshaft timing system applied thereto.
Figure 11:
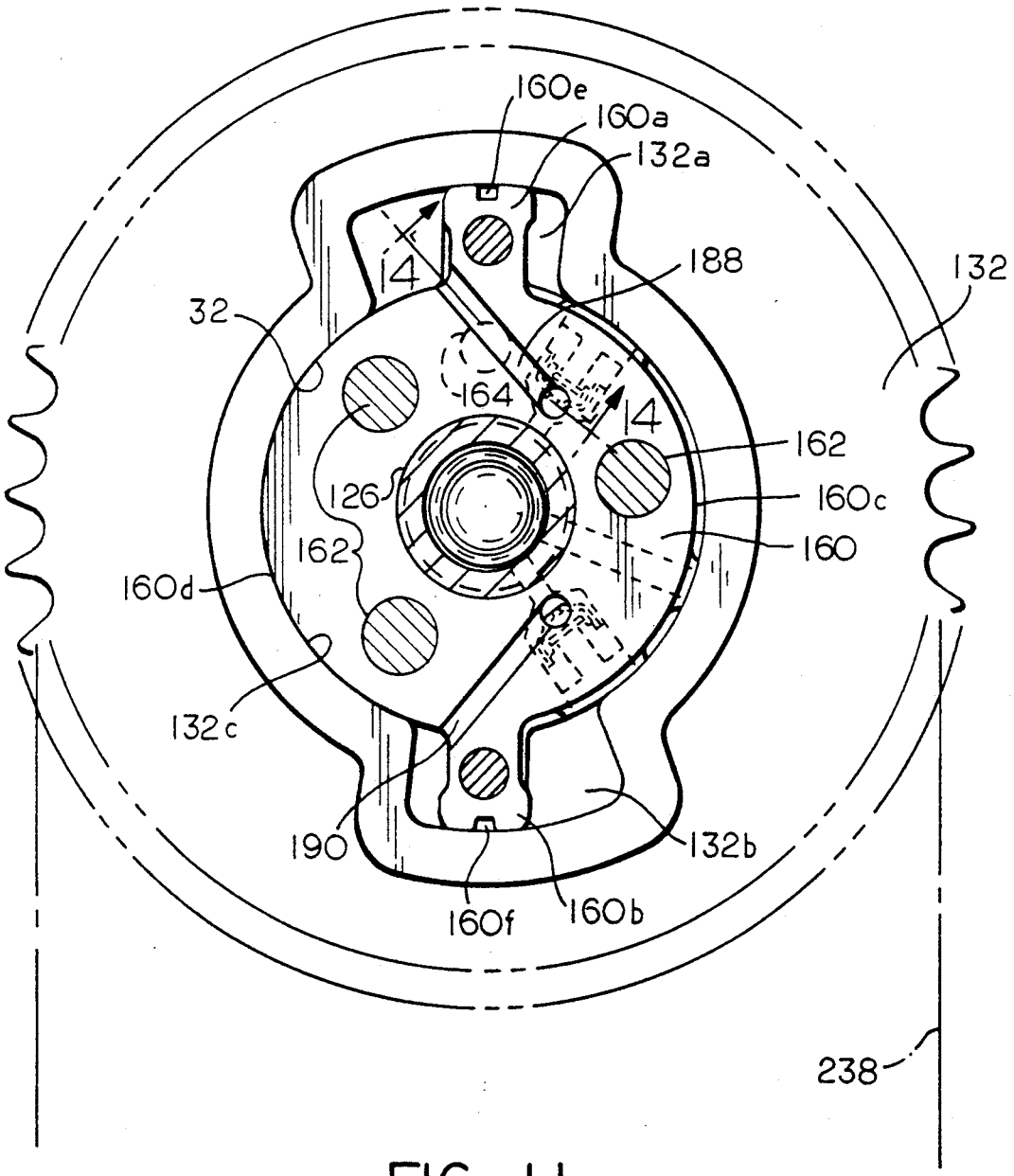
FIG. 11 is a view similar to FIG. 10 with a portion of the structure thereof removed to more clearly illustrate other portions thereof.

The camshaft 26 carries another sprocket, namely sprocket 32, FIG. 3, 4 and 6, journalled thereon to be oscillatable through a limited arc with respect thereto and to be otherwise rotatable with the camshaft 26. Rotation of the camshaft 26 is transmitted to an intake camshaft 34 by a chain 36 which is trained around the sprocket 32 and a sprocket 38 that is keyed to the intake camshaft 34. As shown, the sprockets 32 and 38 are equal in diameter to provide for equivalent rates of rotation between the camshaft 26 and the camshaft 34. The use of a belt in place of the chain 36 is also contemplated.

As is illustrated in FIG. 6, an end of each of the camshafts 26 and 34 is journalled for rotation in bearings 42 and 44, respectively, of the head 50, which is shown fragmentarily and which is bolted to an engine block, otherwise not shown, by bolts 48. The opposite ends of the camshafts 26 and 34, not shown, are similarly journalled for rotation in an opposite end, also not shown, of the head 50. The sprocket 38 is keyed to the camshaft 34 at a location of the camshaft 34 which is outwardly of the head 50. Similarly, the sprockets 32 and 30 are positioned, in series, on the camshaft 26 at locations outwardly of the head 50, the sprocket 32 being transversely aligned with the sprocket 38 and the sprocket 30 being positioned slightly outwardly of the sprocket 32, to be transversely aligned with the sprocket 24.

Figure 2:
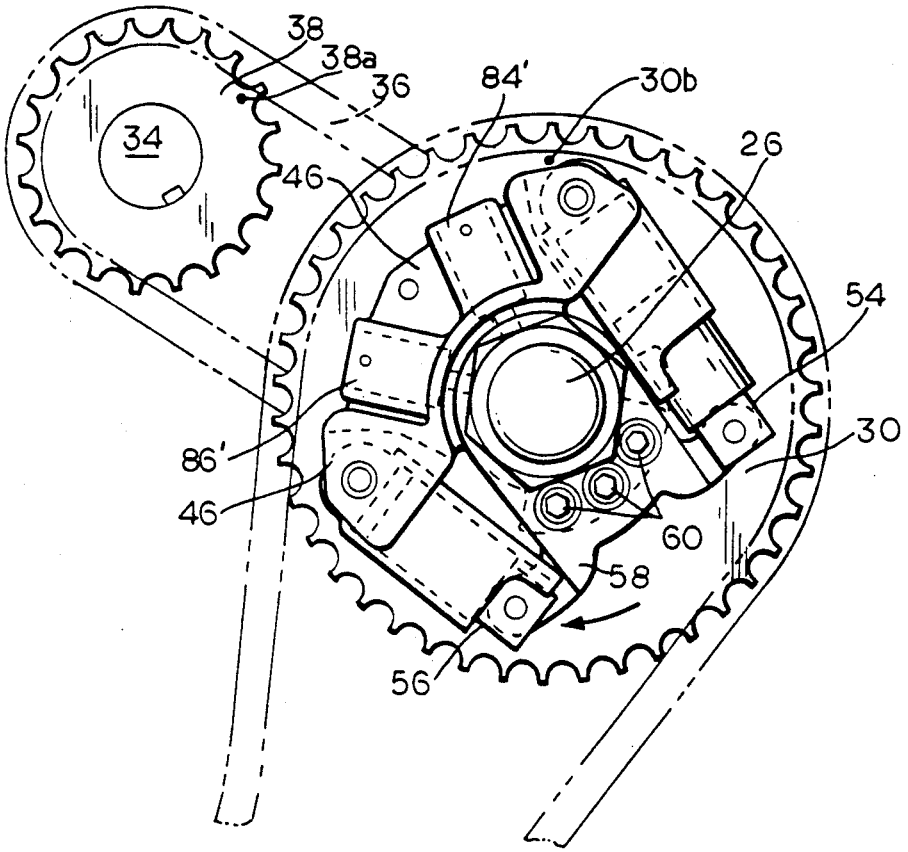
FIG. 2 is a fragmentary view similar to a portion of FIG. 1 showing the intake camshaft in an advanced position relative to the exhaust camshaft.

The sprocket 32 has an arcuate retainer 52 (FIGS. 7 and 8) as an integral part thereof, and the retainer 52 extends outwardly from the sprocket 32 through an arcuate opening 30*a* in the sprocket 30. The sprocket 30 has an arcuate hydraulic body 46 bolted thereto and the hydraulic body 46, which houses certain of the hydraulic components of the associated hydraulic control system, receives and pivotably supports the body end of each of a pair of oppositely acting, single acting hydraulic cylinders 54 and 56 which are positioned on opposite sides of the longitudinal axis of the camshaft 26. The piston ends of the cylinders 54 and 56 are pivotally attached to an arcuate bracket 58, and the bracket 58 is secured to the sprocket 32 by a plurality of threaded fasteners 60. Thus, by extending one of the cylinders 54 and 56 and by simultaneously retracting the other of the cylinders 54 and 56, the arcuate position of the sprocket 32 will be changed relative to the sprocket 30, either to advance the sprocket 32 if the cylinder 54 is extended and the cylinder 56 is retracted, which is the operating condition illustrated in FIGS. 2 and 4, or to retard the sprocket 32 relative to the sprocket 30 if the cylinder 56 is extended and the cylinder 54 is retracted, which is the operating condition illustrated in FIGS. 1, 3, 7 and 8. In either case, the retarding or advancing of the position of the sprocket 32 relative to the position of the sprocket 30, which is selectively permitted or prevented in reaction to the direction of torque in the camshaft 26, as explained in the aforesaid U.S. Pat. No. 5,002,023, will advance or retard the position of the camshaft 34 relative to the position of the camshaft 26 by virtue of the chain drive connection provided by the chain 36 between the sprocket 32, which is journalled for limited relative arcuate movement on the camshaft 26, and the sprocket 38, which is keyed to the camshaft 34. This relationship can be seen in the drawing by comparing the relative position of a timing mark 30*b* on the sprocket 30 and a timing mark 38*a* on the sprocket 38 in the retard position of the camshaft 34, as is shown in FIGS. 1 and 3, to their relative positions in the advanced position of the camshaft 34, as is shown in FIGS. 2 and 4.

FIGS. 10–18 illustrate an embodiment of the present invention in which a housing in the form of a sprocket 132 is oscillatingly journalled on a camshaft 126. The camshaft 126 may be considered to be the only camshaft of a single camshaft engine, either of the overhead camshaft type or the in block camshaft type. Alternatively, the camshaft 126 may be considered to be either the intake valve operating camshaft or the exhaust valve operating camshaft of a dual camshaft engine. In any case, the sprocket 132 and the camshaft 126 are rotatable together, and are caused to rotate by the application of torque to the sprocket 132 by an endless roller chain 138, shown fragmentarily, which is trained around the sprocket 132 and also around a crankshaft, not shown. As will be hereinafter described in greater detail, the sprocket 132 is oscillatingly journalled on the camshaft 126 so that it is oscillatable at least through a limited arc with respect to the camshaft 126 during the rotation of the camshaft, an action which will adjust the phase of the camshaft 126 relative to the crankshaft.

An annular pumping vane 160 is fixedly positioned on the camshaft 126, the vane 160 having a diametrically opposed pair of radially outwardly projecting lobes 160*a*, 160*b* and being attached to an enlarged end portion 126*a* of the camshaft 126 by bolts 162 which pass through the vane 160 into the end portion 126*a*. In that regard, the camshaft 126 is also provided with a thrust shoulder 126*b* to permit the camshaft to be accurately positioned relative to an associated engine block, not shown. The pumping vane 160 is also precisely positioned relative to the end portion 126*a* by a dowel pin 164 which extends therebetween. The lobes 160*a*, 160*b* are received in radially outwardly projecting recesses 132*a*, 132*b*, respectively, of the sprocket 132, the circumferential extent of each of the recesses 132*a*, 132*b* being somewhat greater than the circumferential extent of the vane lobe 160*a*, 160*b* which is received in such recess to permit limited oscillating movement of the sprocket 132 relative to the vane 160. The recesses 132*a*, 132*b* are closed around the lobes 160*a*, 160*b*, respectively, by spaced apart, transversely extending annular plates 166, 168 which are fixed relative to the vane 160, and, thus, relative to the camshaft 126, by bolts 170 which extend from one to the other through the same lobe, 160*a*, 160*b*. Further, the inside diameter 132*c* of the sprocket 132 is sealed with respect to the outside diameter of the portion 160*d* of the vane 160 which is between the lobes 160*a*, 160*b*, and the tips of the lobes 160*a*, 160*b* of the vane 160 are provided with seal receiving slots 160*e*, 160*f*, respectively. Thus each of the recesses 132*a*, 132*b* of the sprocket 132 is capable of sustaining hydraulic pressure, and within each recess 132*a*, 132*b*, the portion on each side of the lobe 160*a*, 160*b*, respectively, is capable of sustaining hydraulic pressure.

Figure 19:
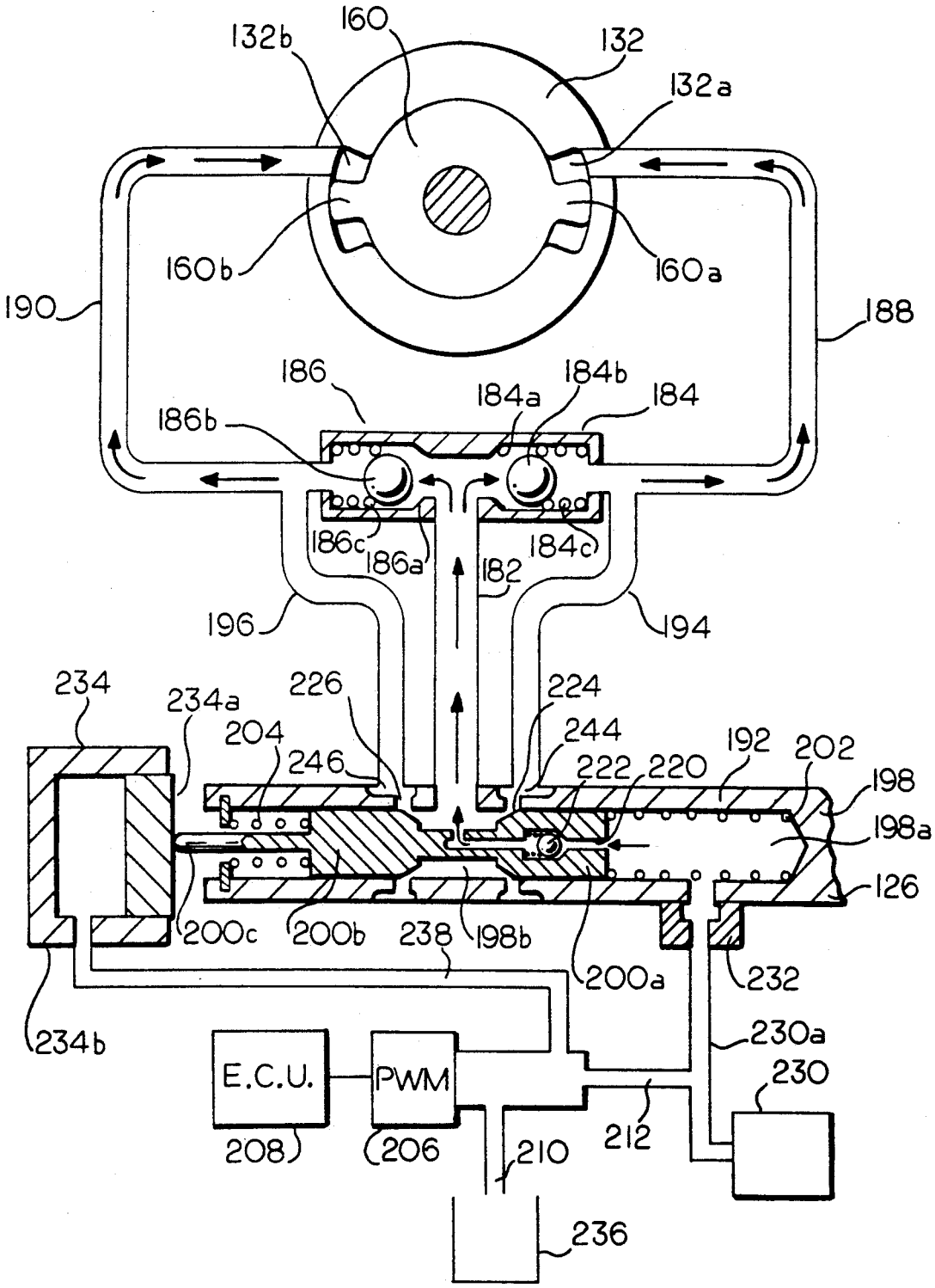
FIG. 19 is a schematic view of the hydraulic equipment of the variable camshaft timing arrangement according to an embodiment containing a tapered spool valve illustrating the valve in the null position.

The functioning of the structure of the embodiment of FIGS. 10–18, as thus far described, may be understood by reference to FIG. 19. It also is to be understood, however, that the hydraulic control system of FIG. 19 is also applicable to an opposed hydraulic cylinder VCT system corresponding to the embodiment of FIGS. 1–9, as well as to a vane type VCT system corresponding to the embodiment of FIGS. 10–18.

In any case, hydraulic fluid, illustratively in the form of engine lubricating oil, flows into the recesses 132*a*, 132*b* by way of a common inlet line 182. The inlet line 182 terminates at a juncture between opposed check valves 184 and 186 which are connected to the recesses 132a, 132b, respectively, by branch lines 188, 190, respectively. The check valves 184, 186 have annular seats 184a, 186a, respectively, to permit the flow of hydraulic fluid through the check valves 184, 186 into the recesses 132a, 132b, respectively. The flow of hydraulic fluid through the check valves 184, 186 is blocked by floating balls 184b, 186b, respectively, which are resiliently urged against the seats 184a, 186a, respectively, by springs 184c, 186c, respectively. The check valves 184, 186, thus, permit the initial filling of the recesses 132a, 132b and provide for a continuous supply of make-up hydraulic fluid to compensate for leakage therefrom. Hydraulic fluid enters the line 182 by way of a spool valve 192, which is incorporated within the camshaft 126, and hydraulic fluid is returned to the spool valve 192 from the recesses 132a, 132b by return lines 194, 196, respectively.

The spool valve 192 is made up of a cylindrical member 198 and a spool 200 which is slidable to and fro within the member 198. The spool 200 has cylindrical lands 200a and 200b on opposed ends thereof, and the lands 200a and 200b, which fit snugly within the member 198, are positioned so that the land 200b will block the exit of hydraulic fluid from the return line 196, or the land 200a will block the exit of hydraulic fluid from the return line 194, or the lands 200a and 200b will block the exit of hydraulic fluid from both the return lines 194 and 196, as is shown in FIG. 19, where the camshaft 126 is being maintained in a selected intermediate position relative to the crankshaft of the associated engine.

Figure 20:
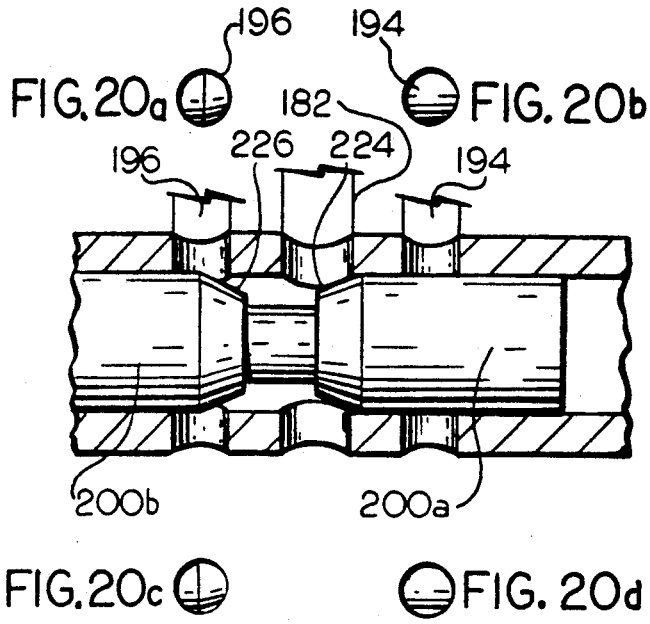
FIG. 20 is a schematic of a tapered spool valve with projections showing the cross-sectional area of the intake and exhaust ports (FIGS. **20*a*–20*d***) to illustrate how a tapered valve varies flow area.
Figure 21:
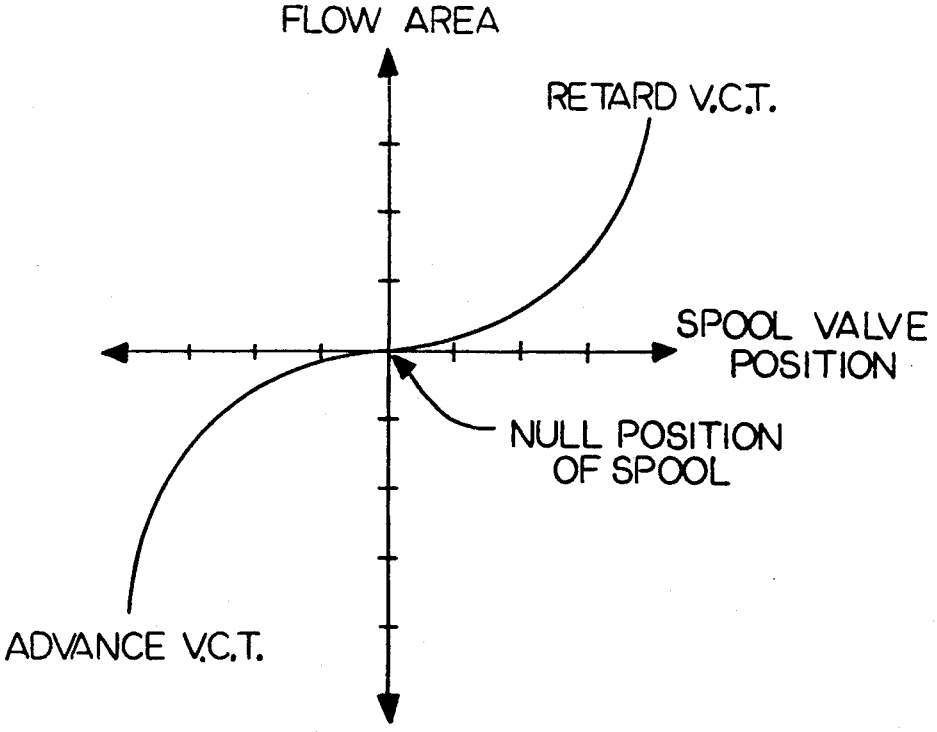
FIG. 21 is a graph illustrating the flow characteristics of a tapered valve such as that shown in FIG. 20.

In some hydraulic valves, lands 200a and 200b have tapered areas 224 and 226, respectively, at the end of the lands (FIGS. 19 and 20), which produce a Flow Area versus Spool Valve Position curve as shown in FIG. 21. Such a curve is desirable in the operation of VCT devices as discussed above. However, the tapered sections 224 and 226 of the lands 200a and 200b, respectively, can trap contamination present in the hydraulic fluid and cause the spool 200 to seize when such contamination wedges between the spool 200 and the cylindrical member 198.

Figure 22:
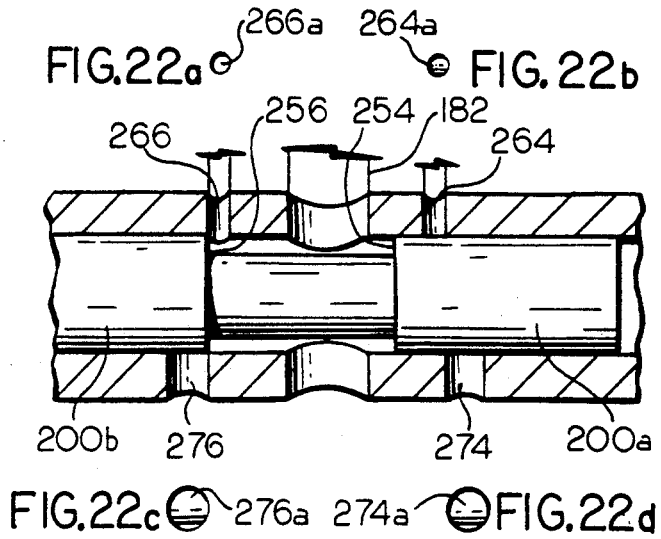
FIG. 22 is a schematic of a square-edged spool valve with non-overlapping staggered orifices of unequal diameter in the sleeve with projections showing the cross-sectional area of those orifices (FIGS. **22*a*–22*d***) to illustrate how the square-edged valve varies flow area.

In a preferred embodiment of the present invention, the lands 200a and 200b are not tapered but have edges 254 and 256, respectively, as shown in FIG. 22, which are squared to avoid collection of the contamination. The cylindrical member 198 is provided with primary orifices 264 and 266 to the return lines 194 and 196, respectively. Secondary orifices 274 and 276 in the cylindrical member 198 also lead to the return lines 194 and 196, respectively, but are staggered from the primary orifices 264 and 266 in an axial direction away from the inlet line 182 such that there is no overlap of orifice areas 264a and 274a of the orifices 264, 266 or orifice areas 266a and 276a of the orifices 266 and 276. The orifices 264 and 274 are positioned such that the land 200a may be moved axially to completely open the orifice 264 while completely blocking the orifice 274. Any further movement of the land 200a away from the inlet line 182 would then allow flow from the orifice 274. The orifices 266 and 276 are symmetrically arranged. Preferably, the orifices 264 and 274 are located 180 degrees apart from the orifices 266 and 276, respectively, in an axial plane perspective, to balance the pressure on the side of the lands 200a and 200b, respectively.

Figure 24:
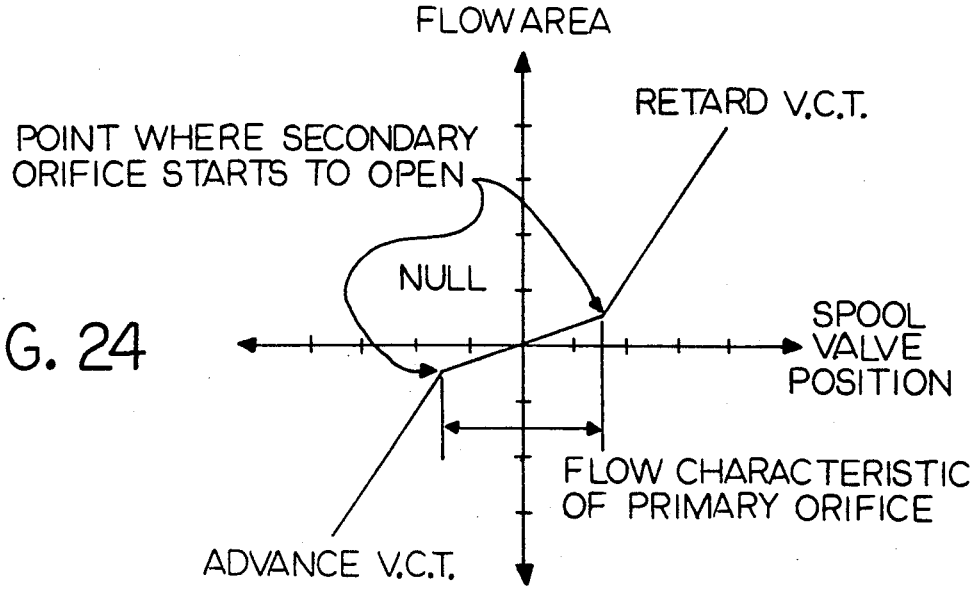
FIG. 24 is a graph illustrating the flow characteristics of a squared-edged valve such as those shown in FIGS. 22 and 23.

FIG. 24 shows the Flow Area versus Spool Valve Position curve of the staggered orifice embodiment of FIG. 22. As can be seen, this embodiment allows only small flow rates and thus small phase shifts of the camshaft 34 with small axial movements of the spool 200, but larger phase shifts of the camshaft 34 through more exposed flow area with larger axial movements of the spool 200.

Figure 23:
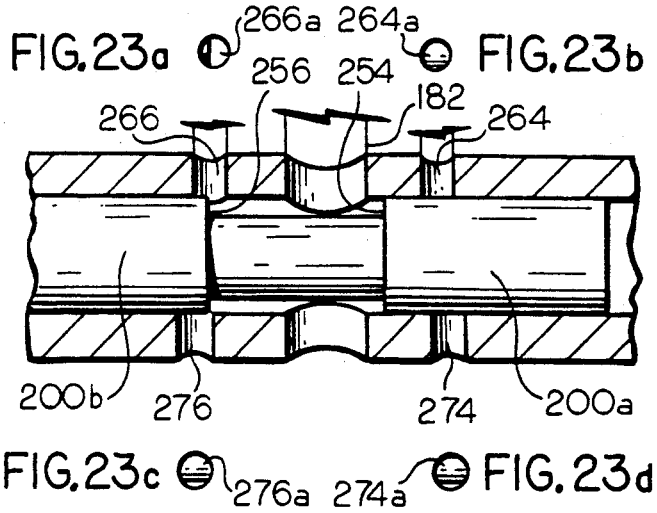
FIG. 23 is a schematic of a square-edged spool valve with overlapping staggered orifices of equal diameter in the sleeve with projections showing the cross-sectional area of those orifices (FIGS. **23*a*–23*d***) to illustrate how the square-edged valve varies flow area.

In an alternative embodiment, the primary orifices 264 and 266 are equal in diameter to the secondary orifices 274 and 276, but the orifice areas 264a and 266a overlap the orifice areas 274a and 276a, respectively, as shown in FIG. 23.

Figure 25:
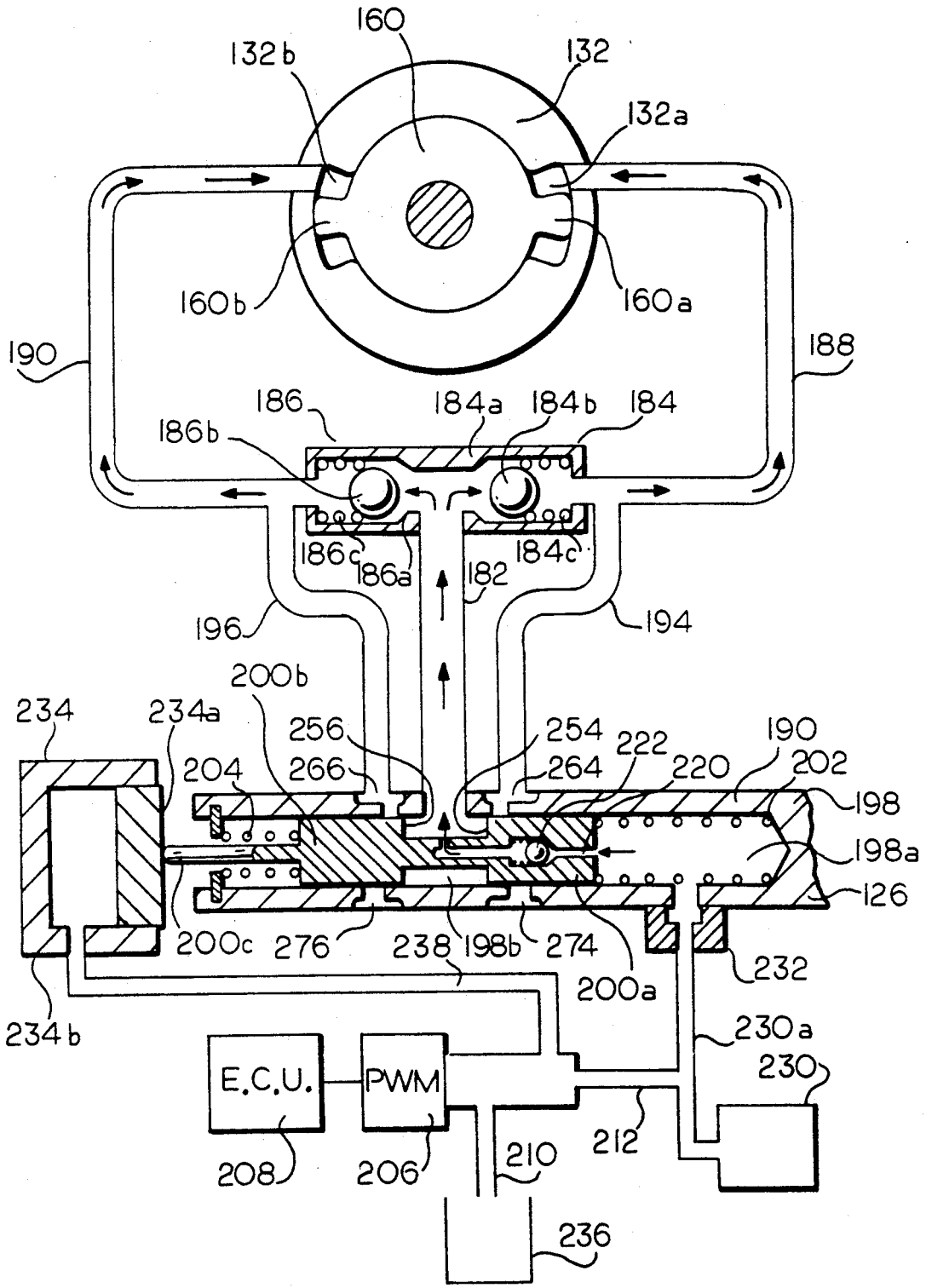
FIG. 25 is a schematic view of the hydraulic equipment of the variable camshaft timing arrangement according to the preferred embodiment and illustrates a condition where the camshaft phase is being maintained in a selected position.
Figure 26:
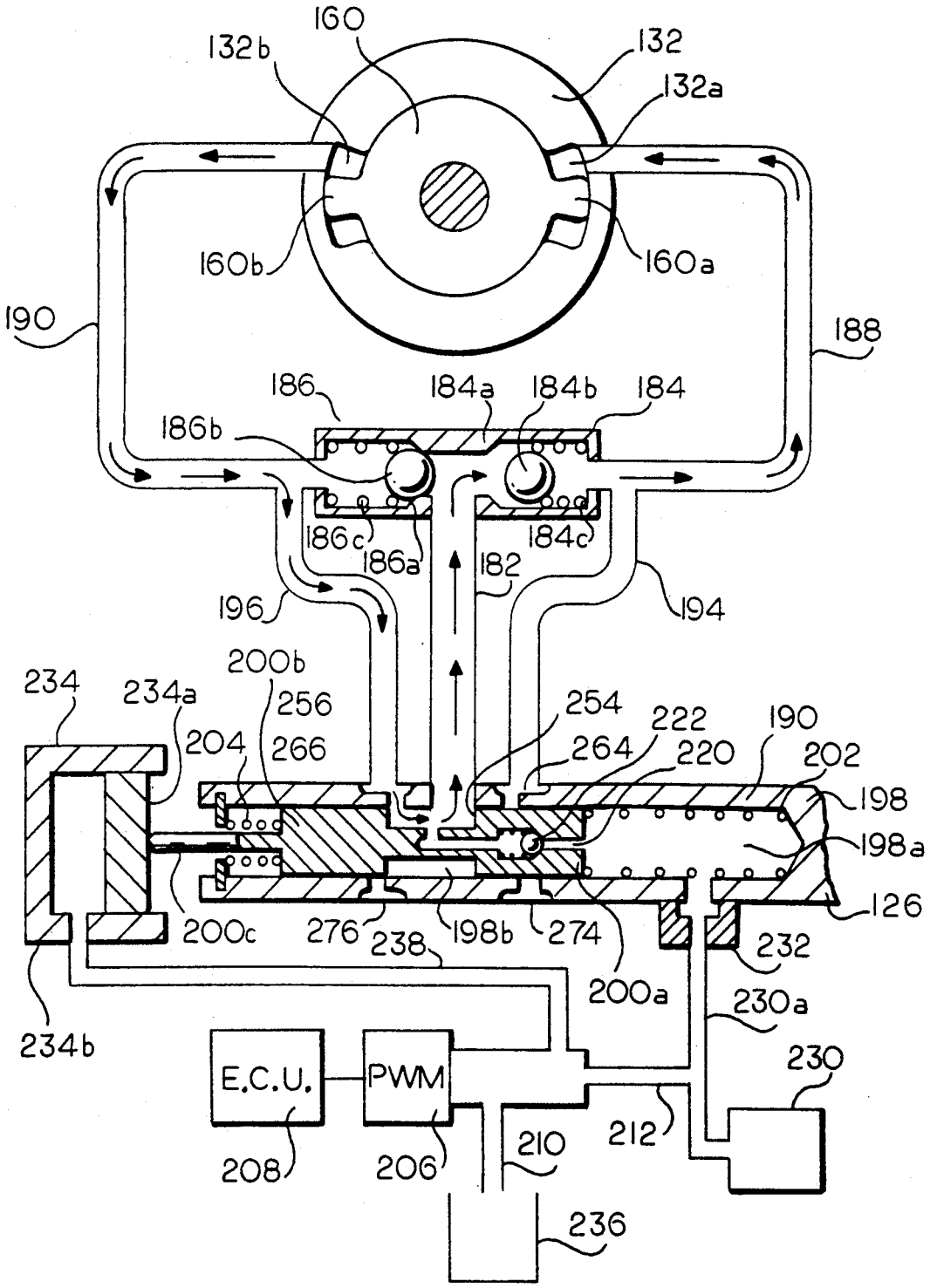
FIG. 26 is a schematic view similar to FIG. 25 and illustrates a condition where the camshaft is shifting in the direction of the advanced position of the variable camshaft timing arrangement which is illustrated in FIG. 4.
Figure 27:
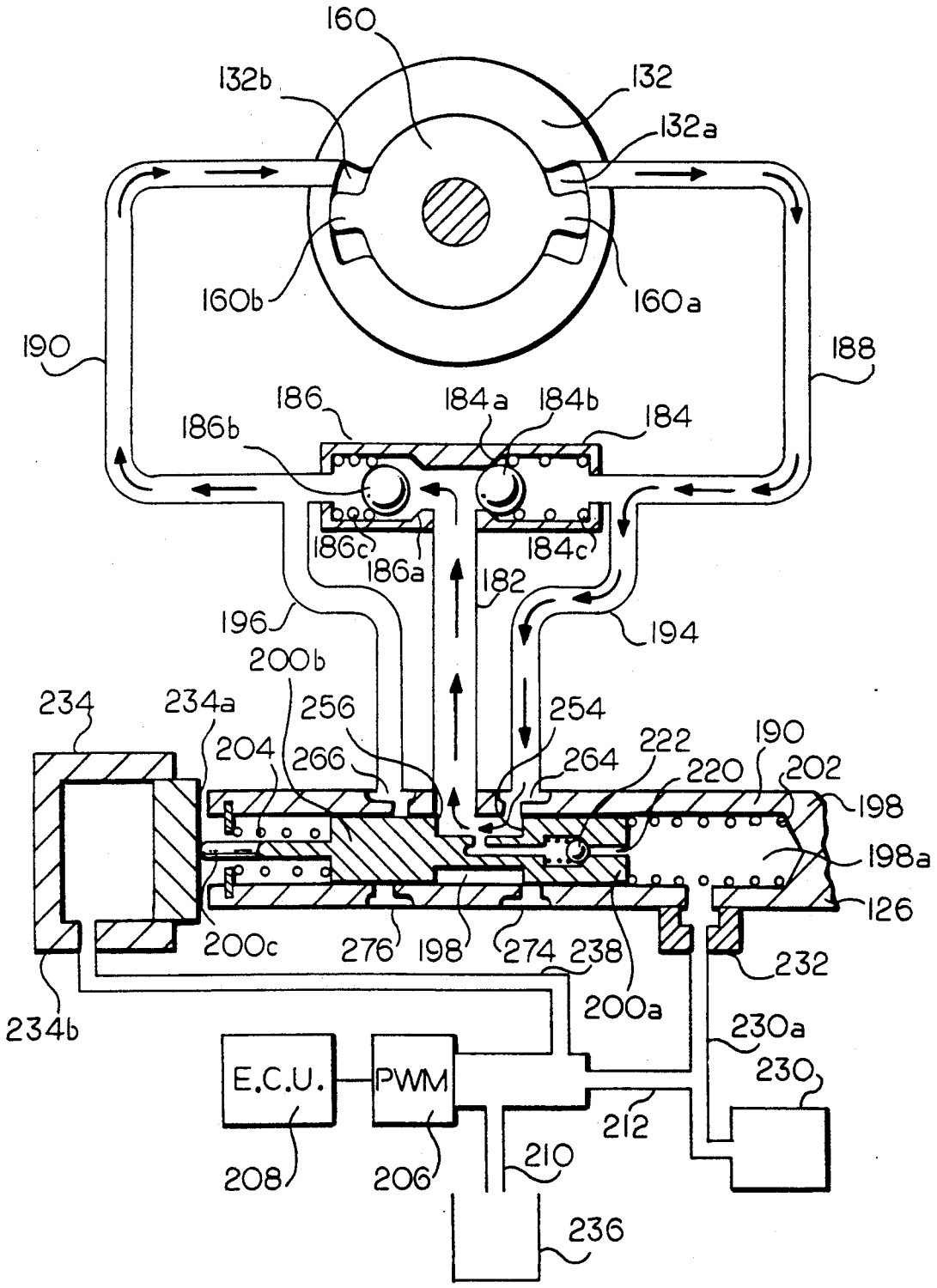
FIG. 27 is a schematic view similar to FIGS. 25 and 26 and illustrates a condition where the camshaft phase is shifting in the direction of the retarded position of the arrangement which is illustrated in FIG. 3.

FIG. 27 shows a schematic similar to FIG. 19 except that the spool valve 192 is arranged as shown in FIG. 22. FIG. 27 depicts the situation in which the land 200b is blocking the exit of hydraulic fluid from return line 196 and camshaft 34 is shifting in the direction of its retarded position. FIG. 26 shows the land 200a blocking the exit of hydraulic fluid from the return line 194 and the camshaft 34 is shifting in the direction of its advanced position. FIG. 25 shows the lands 200a and 200b blocking exit of hydraulic fluid from the return lines 194 and 196, respectively, and camshaft 34 is being maintained in a selected intermediated position.

Figure 28:
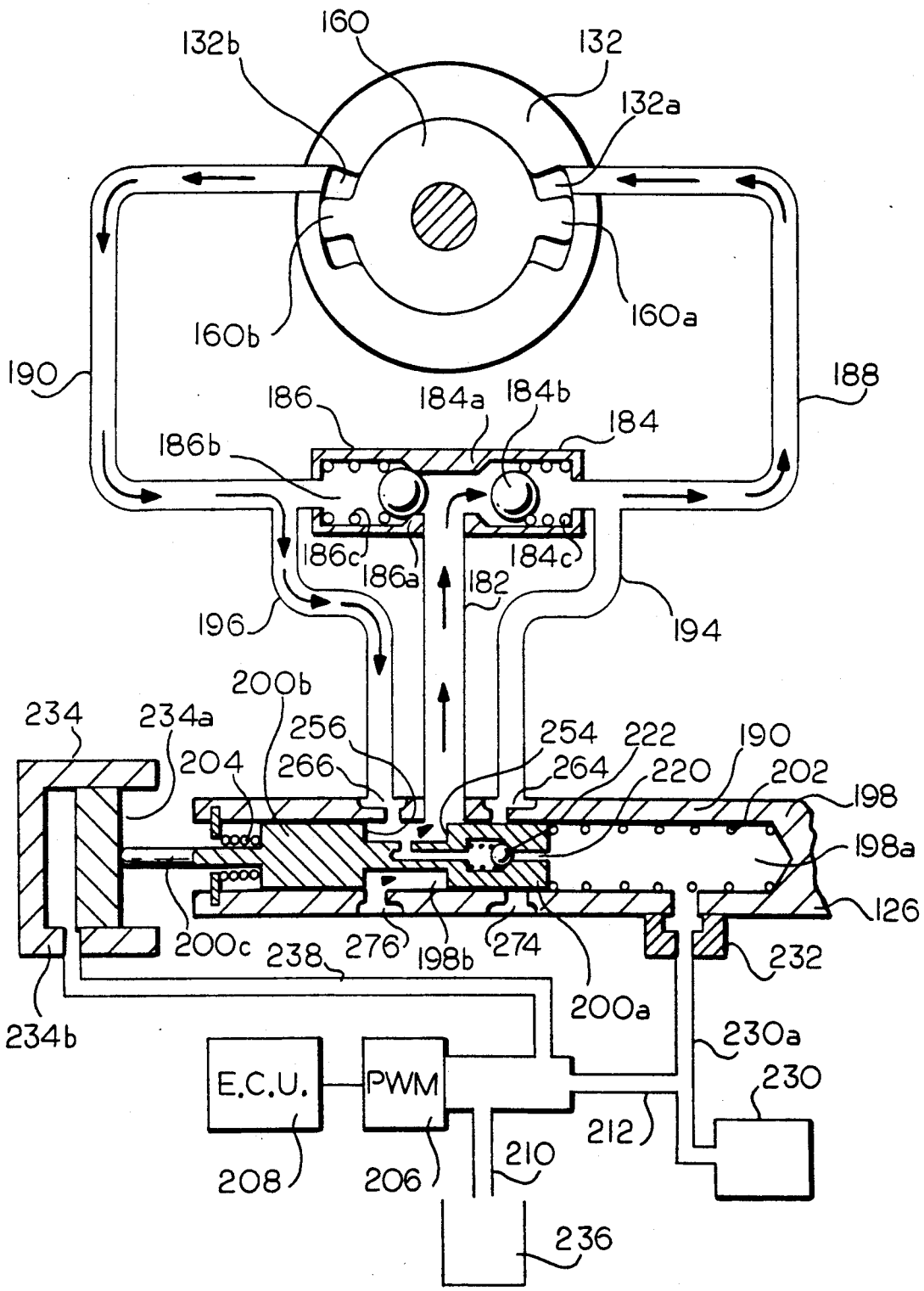
FIG. 28 is a schematic view similar to FIG. 26 and illustrates a condition where the square edged spool value has moved to a position allowing flow through both the primary and the secondary orifice to the advance side of the vane.
Figure 29:
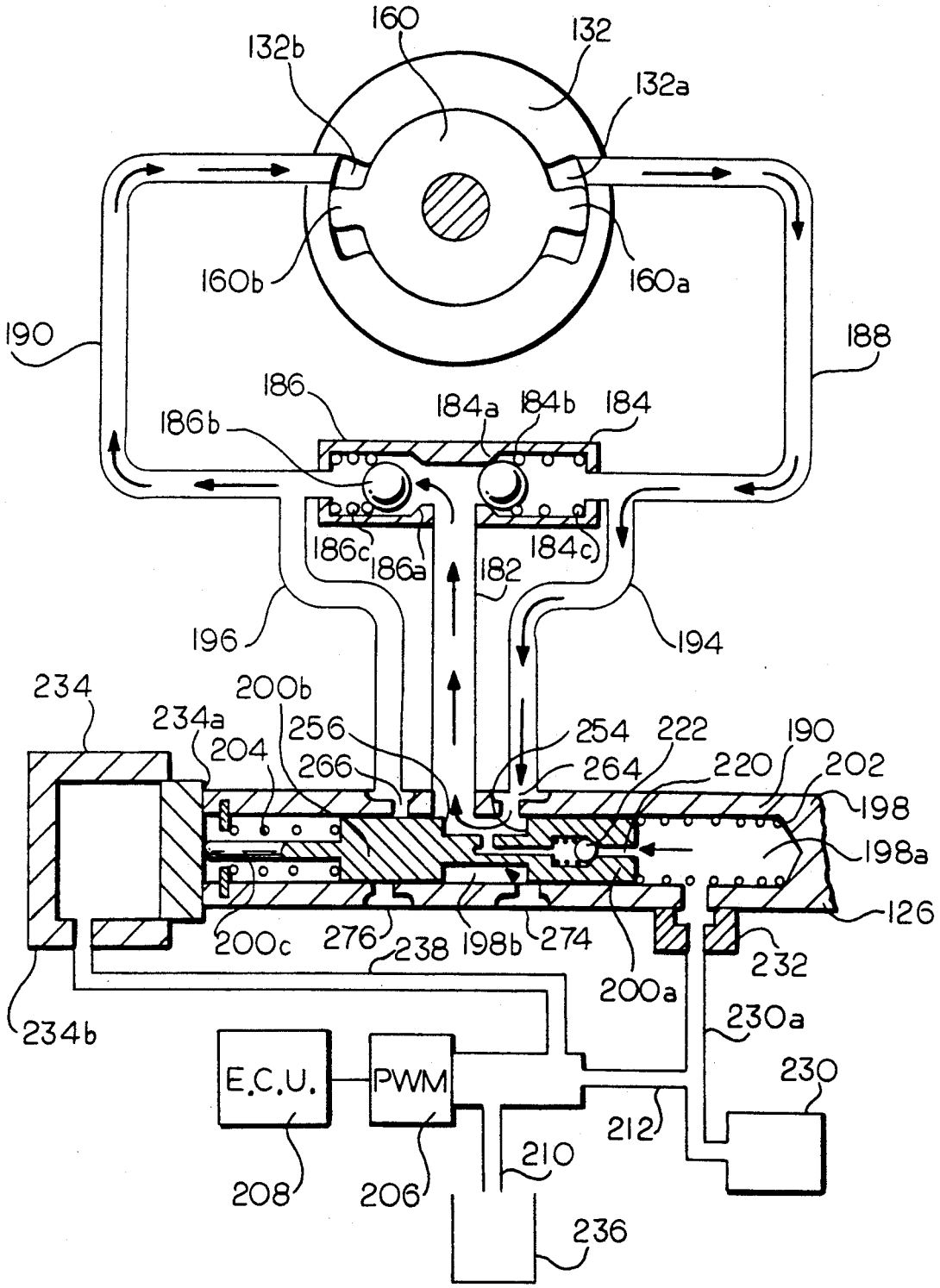
FIG. 29 is a schematic view similar to FIG. 26 and illustrates a condition where the square edged spool valve has moved to a position allowing flow through both the primary and the secondary orifice to the retard side of the vane.

FIG. 28 shows a schematic similar to FIG. 26 but where spool 200 is positioned such that hydraulic fluid can flow from return line 194 through secondary orifice 276 in addition to primary orifice 266. Thus, a higher advance rate of camshaft phase shaft can be achieved. FIG. 29 shows a schematic similar to FIG. 27 but where spool 200 is positioned such that hydraulic fluid can flow from return line 196 through secondary orifice 274 in addition to primary orifice 264, thus achieving a higher return rate of camshaft phase shift.

The position of the spool 200 within the member 198 is influenced by an opposed pair of springs 202, 204 which act on the ends of the lands 200a, 200b, respectively. Thus, the spring 202 resiliently urges the spool 200 to the left, in the orientation illustrated in FIG. 19, and the spring 204 resiliently urges the spool 200 to the right in such orientation. The position of the spool 200 within the member 198 is further influenced by a supply of pressurized hydraulic fluid within a portion 198a of the member 198, on the outside of the land 200a, which urges the spool 200 to the left. The portion 198a of the member 198 receives its pressurized fluid (engine oil) directly from the main oil gallery ("MOG") 230 of the engine by way of a conduit 230a, and this oil is also used to lubricate a bearing 232 in which the camshaft 126 of the engine rotates.

The control of the position of the spool 200 within the member 198 is in response to hydraulic pressure within a control pressure cylinder 234 whose piston 234a bears against an extension 200c of the spool 200. The surface area of the piston 234a is greater than the surface area of the end of the spool 200 which is exposed to hydraulic pressure within the portion 198, and is preferably twice as great. Thus, the hydraulic pressures which act in opposite directions on the spool 200 will be in balance when the pressure within the cylinder 234 is one-half that of the pressure within the portion 198a, assuming that the surface area of the piston 234a is twice that of the end of the land 200a of the spool. This facilitates the control of the position of the spool 200 in that, if the springs 202 and 204 are balanced, the spool 200 will remain in its null or centered position, as illustrated in FIG. 19, with less than full engine oil pressure in the cylinder 234, thus allowing the spool 200 to be moved in either direction by increasing or decreasing the pressure in the cylinder 234, as the case may be. Further, the operation of the springs 202, 204 will ensure the return of the spool 200 to its null or centered position when the hydraulic loads on the ends of the lands 200*a*, 200*b* come into balance. While the use of springs such as the springs 202, 204 is preferred in the centering of the spool 200 within the member 198, it is also contemplated that electromagnetic or electrooptical centering means can be employed, if desired.

Figure 12:
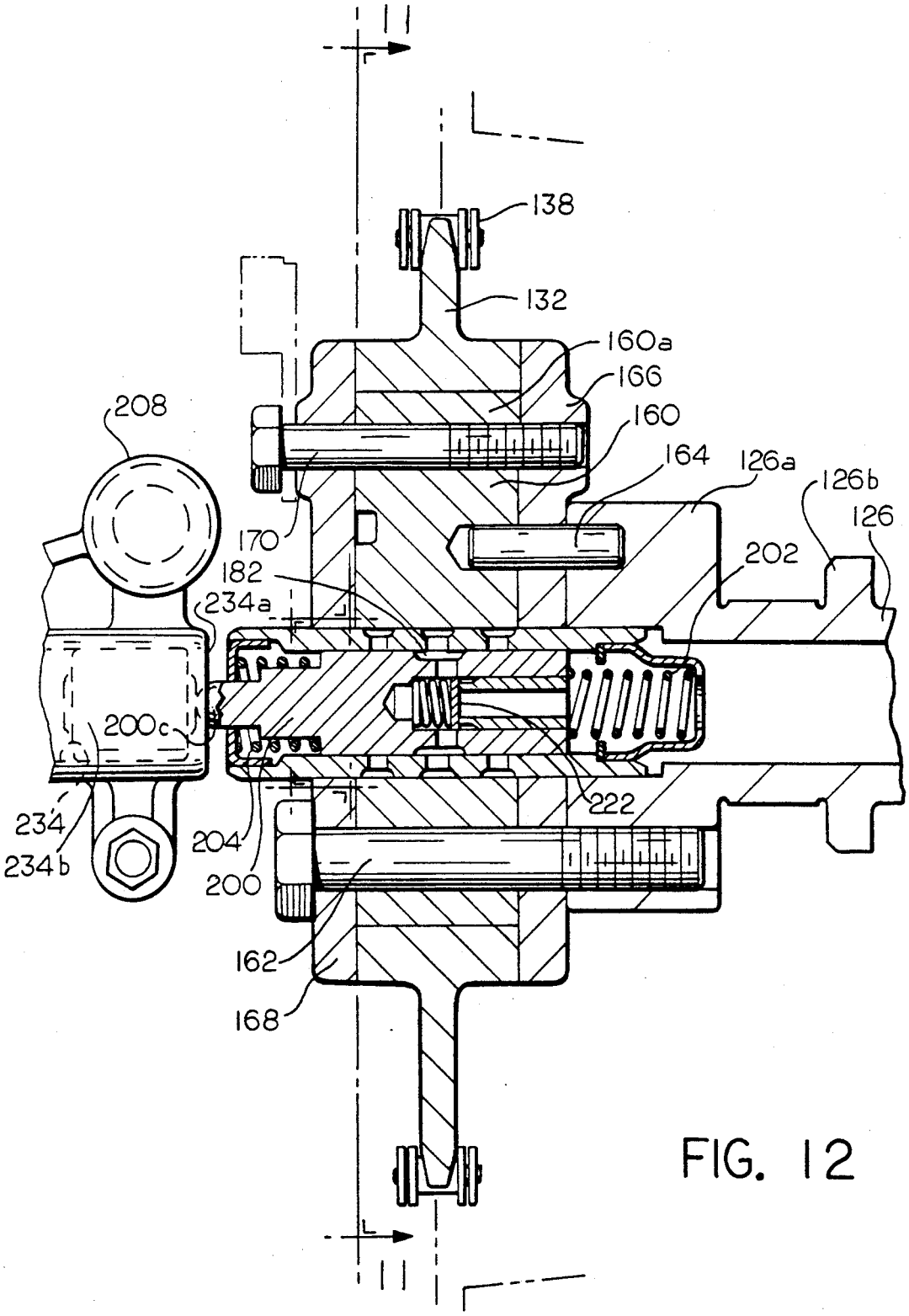
FIG. 12 is a sectional view taken on line 12—12 of FIG. 11.
Figure 13:
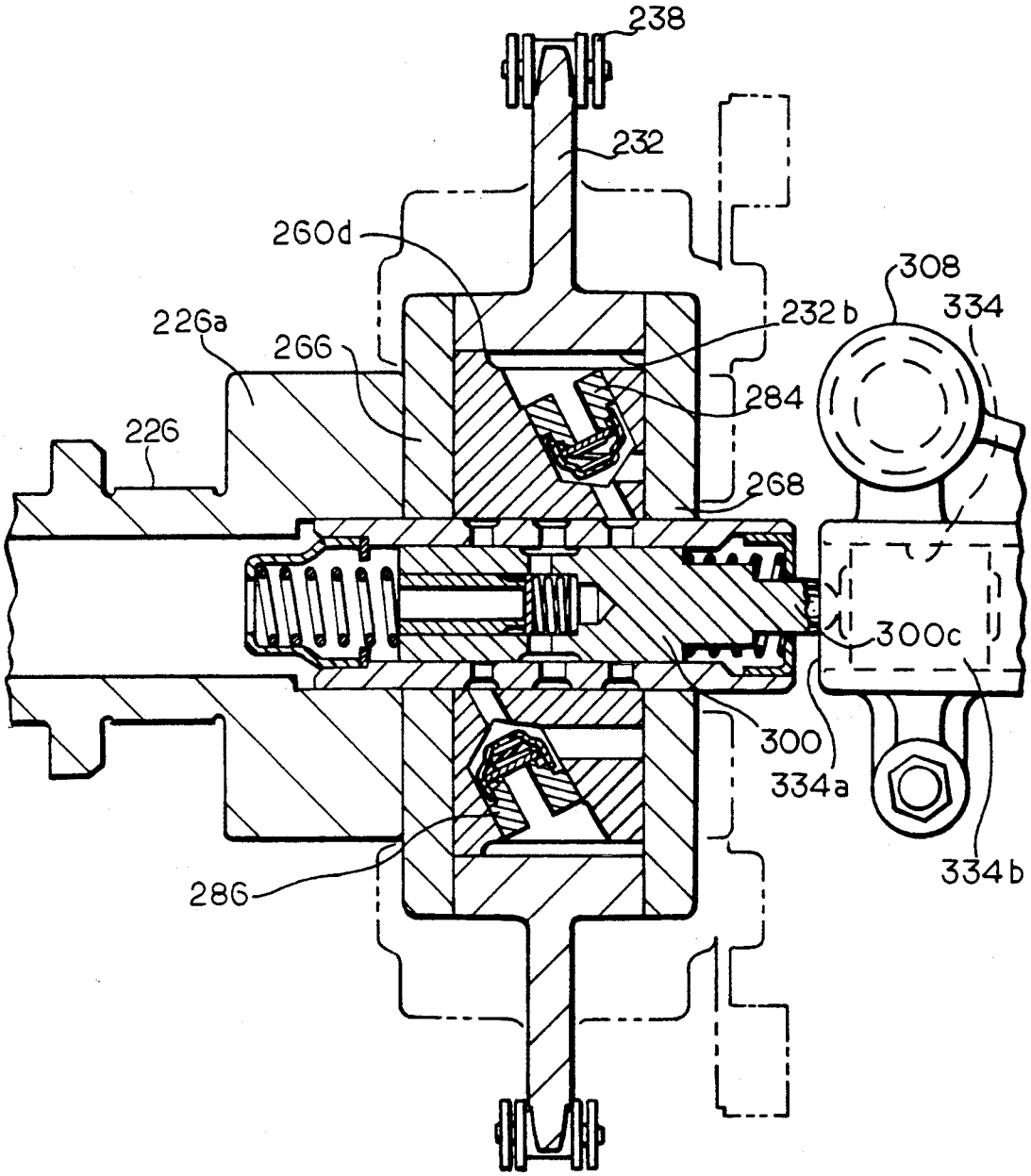
FIG. 13 is a sectional view taken on line 13—13 of FIG. 11.
Figure 15:
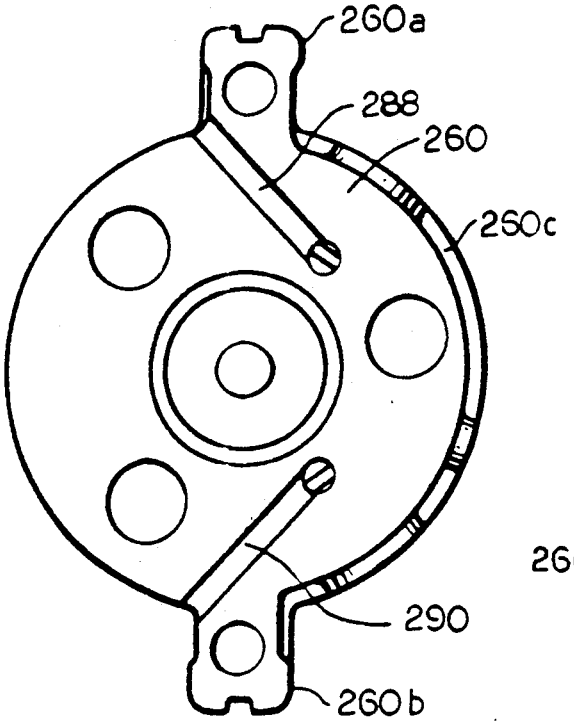
FIG. 15 is an end elevational view of an element of the variable camshaft timing system of FIGS. 10–14.
Figure 16:
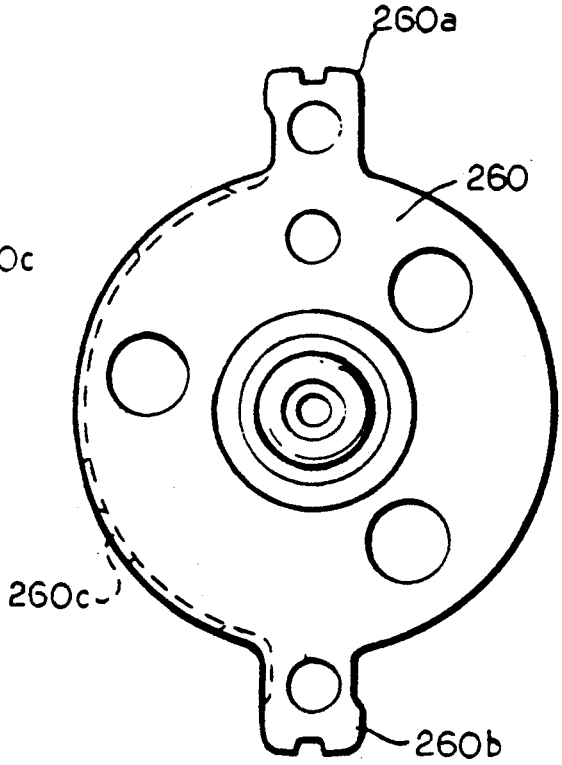
FIG. 16 is an elevational view of the element of FIG. 15 from the opposite end thereof.
Figure 14:
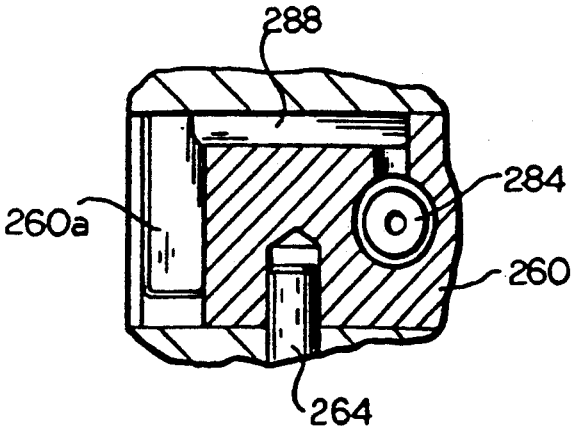
FIG. 14 is a sectional view taken on line 14—14 of FIG. 11.
Figure 17:
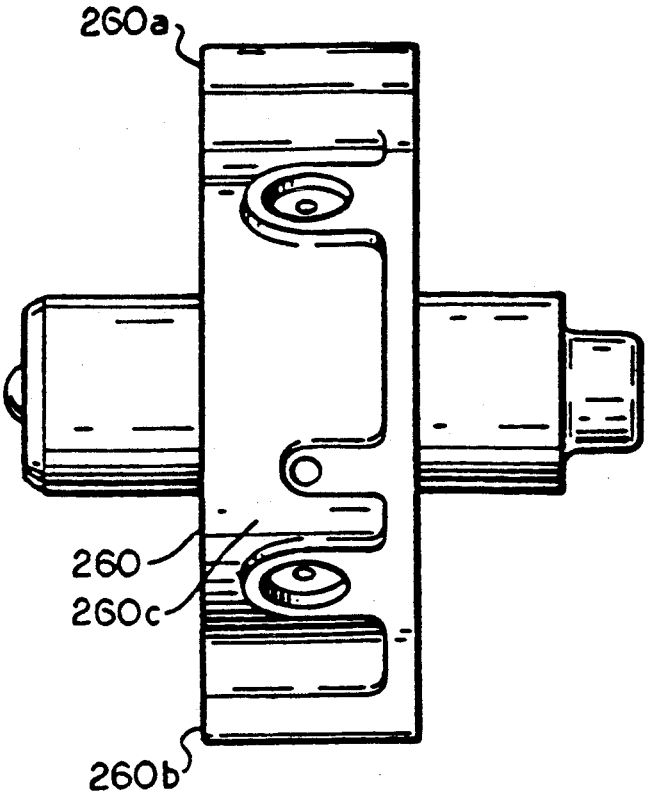
FIG. 17 is a side elevational view of the element of FIGS. 15 and 16.
Figure 18:
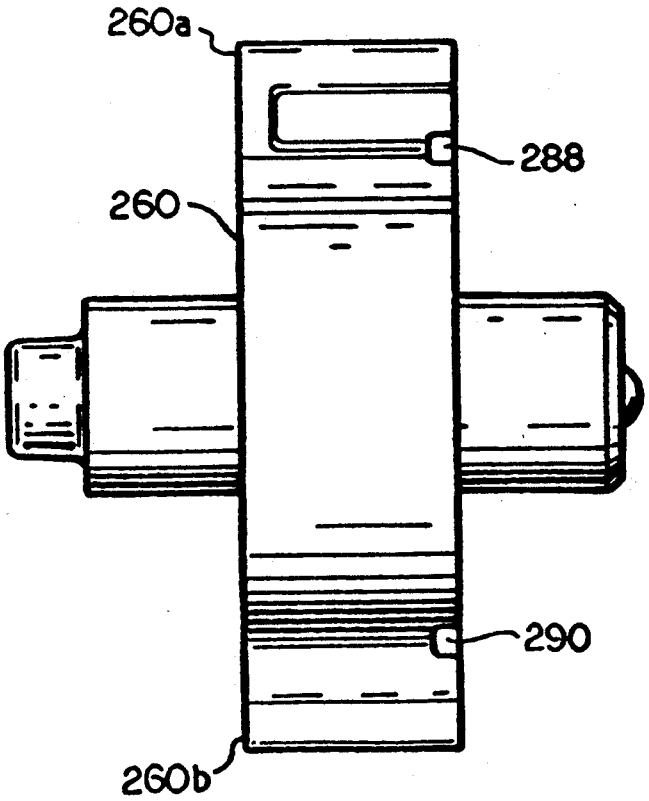
FIG. 18 is an elevational view of the element of FIG. 17 from the opposite side thereof.

The pressure within the cylinder 234 is controlled by a solenoid 206, preferably of the pulse width modulated type (PWM), in response to a control signal from an electronic engine control unit (ECU) 208, shown schematically, which may be of conventional construction. With the spool 200 in its null position when the pressure in the cylinder 234 is equal to one-half the pressure in the portion 198*a*, as heretofore described, the on-off pulses of the solenoid 206 will be of equal duration; by increasing or decreasing the on duration relative to the off duration, the pressure in the cylinder 234 will be increased or decreased relative to such one-half level, thereby moving the spool 200 to the right or to the left, respectively. The solenoid 206 receives engine oil from the engine oil gallery 230 through an inlet line 212 and selectively delivers engine oil from such source to the cylinder 234 through a supply line 238. Excess oil from the solenoid 206 is drained to a sump 236 by way of a line 210. As is shown in FIGS. 12 and 13, the cylinder 234 may be mounted at an exposed end of the camshaft 126 so that the piston 234*a* bears against an exposed free end 200*c* of the spool 200. In this case, the solenoid 208 is preferably mounted in a housing 234*b* which also houses the cylinder 234*a*.

By using imbalances between oppositely acting hydraulic loads from a common hydraulic source on the opposed ends of the spool 200 to move it in one direction or another, as opposed to using imbalances between an hydraulic load on one end and a mechanical load on an opposed end, the control system of FIG. 19 is capable of operating independently of variations in the viscosity or pressure of the hydraulic system. Thus, it is not necessary to vary the duty cycle of the solenoid 208 to maintain the spool 200 in any given position, for example, in its centered or null position, as the viscosity or pressure of the hydraulic fluid changes during the operation of the system. In that regard, it is to be understood that the centered or null position of the spool 200 is the position where no change in camshaft to crankshaft phase angle is occurring, and it is important to be able to rapidly and reliably position the spool 200 in its null position for proper operation of a VCT system.

Make-up oil for the recesses 132*a*, 132*b* of the sprocket 132 to compensate for leakage therefrom is provided by way of a small, internal passage 220 within the spool 200, from the passage 198*a* to an annular space 198*b* of the cylindrical member 198, from which is can flow into the inlet line 182. A check valve 222 is positioned within the passage 220 to block the flow of oil from the annular space 198*b* to the portion 198*a* of the cylindrical member 198.

The vane 160 is alternatingly urged in clockwise and counterclockwise directions by the torque pulsations in the camshaft 126 and these torque pulsations tend to oscillate the vane 160, and, thus, the camshaft 126, relative to the sprocket 132. However, in the FIG. 19 position of the spool 200 within the cylindrical member 198, such oscillation is prevented by the hydraulic fluid within the recesses 132*a*, 132*b* of the sprocket 132 on opposite sides of the lobes 160*a*, 160*b*, respectively, of the vane 160, because no hydraulic fluid can leave either of the recesses 132*a*, 132*b*, since both return lines 194, 196 are blocked by the position of the spool 200. If, for example, it is desired to permit the camshaft 126 and vane 160 to move in a counterclockwise direction with respect to the sprocket 132, it is only necessary to increase the pressure within the cylinder 234 to a level greater than one-half that in the portion 198*a* of the cylindrical member. This will urge the spool 200 to the right and thereby unblock the return line 194. In this condition of the apparatus, counterclockwise torque pulsations in the camshaft 126 will pump fluid out of the portion of the recess 132*a* and allow the lobe 162*a* of vane 160 to move into the portion of the recess which has been emptied of hydraulic fluid. However, reverse movement of the vane will not occur as the torque pulsations in the camshaft become oppositely directed unless and until the spool 200 moves to the left, because of the blockage of fluid flow through the return line 196 by the land 200*b* of the spool 200.

The elements of the structure of FIGS. 10–18 which correspond to the elements of FIG. 19, as described above, are identified in FIGS. 10–18 by the reference numerals which were used in FIG. 19, it being noted that the check valves 184 and 186 are disc-type check valves in FIGS. 10–18 as opposed to the ball type check valves of FIG. 19. While disc-type check valves are preferred for the embodiment of FIGS. 10–18, it is to be understood that other types of check valves can also be used.

Although the best mode contemplated by the inventors for carrying out the present invention as of the filling date hereof has been shown and described herein, it will be apparent to those skilled in the art that suitable modifications, variations, and equivalents may be made without departing from the scope of the invention, such scope being limited solely by the terms of the following claims.

What is claimed is:

1. In an internal combustion engine having a rotatable crankshaft and a rotatable camshaft, said camshaft being position variable in a circumferential direction relative to said crankshaft, means for varying the position of said camshaft relative to said crankshaft, said means for varying comprising a source of hydraulic fluid under pressure, a first hydraulic operator, the operation of said first hydraulic operator being effective to vary the position of said camshaft relative to said crankshaft in a given circumferential direction, first conduit means for delivering hydraulic fluid from said source to said first hydraulic operator to operate said first hydraulic operator, a second hydraulic operator, the operation of said second hydraulic operator being effective to vary the position of said camshaft relative to said crankshaft in an opposed circumferential direction, second conduit means for exhausting hydraulic fluid from said first hydraulic operator, third conduit means for delivering hydraulic fluid from said source to said second hydraulic operator to operate the second hydraulic operator, fourth conduit means for exhausting hydraulic fluid from the second hydraulic operator and control means for controlling the exhausting of hydraulic fluid from said first hydraulic operator and said second hydraulic operator to selectively permit hydraulic fluid from said source to operate one or another of said first hydraulic operator and said second hydraulic operator, said control means comprising:

a spool valve in communication with said second conduit means and said fourth conduit means, said spool valve comprising:

a housing having a first primary orifice and a first secondary orifice, both in communication with said second conduit means, said first primary orifice and said first secondary orifice defining a first primary flow area and a first secondary flow area, respectively, said housing also having a second primary orifice and a second secondary orifice, both in communication with said fourth conduit means, said second primary orifice and said second secondary orifice defining a second primary flow area and a second secondary flow area, respectively, and a valve member, said valve member being reciprocable within said housing and comprising first and second opposed ends and first and second spaced apart lands between said opposed ends, said first land being capable of blocking flow through said first primary orifice in first, third and fifth positions of said valve member and permitting flow through said first primary orifice in second and fourth positions of said valve member, said first land also being capable of blocking flow through said first secondary orifice in first, second, third and fifth positions of said valve member and permitting flow through said first secondary orifice in a fourth position of said valve member, said second land being capable of blocking flow through said second primary orifice in first, second and fourth positions of said valve member and permitting flow through said second primary orifice in third and fifth positions of said valve member, said second land also being capable of blocking flow through said second secondary orifice in first, second, third and fourth positions of said valve member and permitting flow through said second secondary orifice in a fifth position of said valve member;

force imposing means imposing a load on a first surface of said valve member to urge said valve member in a given direction;

fifth conduit means for transmitting hydraulic pressure from the source to act on a second surface of said valve member to urge said valve member in an opposed direction, said fifth conduit means comprising a control member therein to controllably increase or reduce the pressure of the source that acts on said second surface of said valve member; and centering means for centering said valve member in a fixed position relative to said housing when the opposed forces acting on said valve member are in balance.

2. An internal combustion engine according to claim 1 wherein said control member comprises a pulse width modulated solenoid.

3. An internal combustion engine according to claim 2 wherein said valve member further comprises a portion between said first and second lands, said portion defining an hydraulic fluid flow passage with said housing of said spool valve; wherein said control means further comprises sixth conduit means in communication with said hydraulic fluid flow passage in each of said first, second, third, fourth and fifth positions of said valve member and with said first conduit means and said third conduit means, said sixth conduit means permitting the flow of hydraulic fluid from said hydraulic fluid flow passage to said first hydraulic operator and said second hydraulic operator, whereby hydraulic fluid being exhausted from one of said first hydraulic operator and said second hydraulic operator will be returned to the other of said first hydraulic operator and said second hydraulic operator without returning to the source of hydraulic fluid.

4. An internal combustion engine according to claim 3 and further comprising check valve means for preventing flow of hydraulic fluid from said first hydraulic operator and said second hydraulic operator through said first conduit means and said third conduit means into said sixth conduit means.

5. An internal combustion engine according to claim 4 wherein said valve member has an internal passage for permitting flow of hydraulic fluid from the source of hydraulic fluid through said valve member from said one of the opposed ends to said hydraulic fluid flow passage, said internal passage having internal passage check valve means for preventing flow from said hydraulic fluid flow passage back through said internal passage.

6. An internal combustion engine according to claim 5 wherein said first and second lands are not tapered in those portions of said lands which block flow through said first and second primary and said first and second secondary orifices.

7. An internal combustion engine according to claim 6 wherein said first and second secondary flow areas are greater in flow area than said first and second primary flow areas, respectively.

8. An internal combustion engine according to claim 7 wherein said first and second secondary orifices are located in said housing such that said first and second lands, when said valve member is in said second and third positions, respectively, permit flow through the entire area of said first and second primary flow areas, respectively, while completely blocking flow through said first and second secondary flow areas, respectively.

9. An internal combustion engine according to claim 6 wherein said first and second primary flow areas are equal in area to said first and second secondary flow areas.

10. An internal combustion engine according to claim 9 wherein said first and second secondary orifices are located in said housing such that said first and second lands, when said valve member is in said fourth and fifth positions, respectively, permit flow through part of the area of said first and second secondary flow areas, respectively, before allowing flow through the entire area of said first and second primary flow areas, respectively.

11. An internal combustion engine according to claim 1 wherein the hydraulic fluid under pressure is engine lubricating oil.

12. An internal combustion engine according to claim 1 wherein the camshaft is subject to torque reversals driving the operation thereof and wherein the exhaust of hydraulic fluid from the first and second hydraulic operators occurs selectively in reaction to the direction of torque in the camshaft.

13. An internal combustion engine according to claim 1 and further comprising:

an engine control unit responsive to at least one engine operating condition for controlling the operation of the pulse width modulated solenoid to selectively increase or decrease the hydraulic pressure acting on said second surface of said valve member and thereby change the position of the valve member within the housing of the spool valve.

14. An internal combustion engine according to claim 13 wherein said camshaft comprises a vane secured thereto, said vane being rotatable with said camshaft but being non-oscillatable with respect thereto, said first hydraulic operator and said second hydraulic operator respectively comprising first and second diametrically opposed, radially outwardly projecting lobes of said vane, said internal combustion engine further comprising housing means mounted on said camshaft, said housing means being rotatable with said camshaft and being oscillatable with respect to said camshaft, said housing means having first and second diametrically opposed recesses therein, each of said first and second diametrically opposed recesses being capable of sustaining hydraulic pressure, said first and second diametrically opposed recesses respectively receiving said first and second diametrically opposed lobes of said vane.

* * * * *